United States Patent [19]

Stouffer

[11] 4,151,955

[45] May 1, 1979

[54] OSCILLATING SPRAY DEVICE

[75] Inventor: Ronald D. Stouffer, Silver Spring, Md.

[73] Assignee: Bowles Fluidics Corporation, Silver Spring, Md.

[21] Appl. No.: 845,117

[22] Filed: Oct. 25, 1977

[51] Int. Cl.[2] ..... B05B 1/08

[52] U.S. Cl. ..... 239/11; 137/835; 239/540; 239/590

[58] Field of Search ..... 239/4, 11, 101, 102, 239/390, 391, 396, 589, 590, 590.5, DIG. 3, 540; 137/808–811, 814, 819, 820, 825, 826, 829, 833, 835, 839

[56] References Cited

U.S. PATENT DOCUMENTS

| | | | |
|---|---|---|---|
| Re. 27,938 | 3/1974 | Bauer | 239/102 |
| 3,423,026 | 1/1969 | Carpenter | 239/102 X |
| 3,432,102 | 3/1969 | Turner et al. | 239/242 |
| 3,998,386 | 12/1976 | Viets et al. | 239/102 |
| 4,052,002 | 10/1977 | Stouffer | 239/102 X |

FOREIGN PATENT DOCUMENTS

| | | | |
|---|---|---|---|
| 2140526 | 2/1973 | Fed. Rep. of Germany | 239/102 |

*Primary Examiner*—Johnny D. Cherry
*Attorney, Agent, or Firm*—Rose & Edell

[57] ABSTRACT

A fluid dispersal device utilizes the Karman Vortex street phenomenon to cyclically oscillate a fluid stream before issuing the stream in a desired flow pattern. A chamber includes an inlet and outlet with an obstacle or island disposed therebetween to establish the vortex street. The vortex street causes the stream to be cyclically swept transversely of its flow direction in a manner largely determined by the size and shape of the obstacle relative to the inlet and outlet, the spacing between the obstacle and the outlet, the outlet area, and the Reynolds number of the stream. Depending on these factors, the flow pattern of the stream issued from the outlet may be either: a swept jet, residing wholly in the plane of the device and which breaks up into droplets solely as a result of the cyclic sweeping, the resulting spray pattern forming a line when impinging on a target; or a swept sheet, the sheet being normal to the plane of the device and being swept in the plane of the device, the resulting pattern containing smaller droplets than the swept jet pattern and covering a two-dimensional area when impinging upon a target.

58 Claims, 44 Drawing Figures

FIG. 1
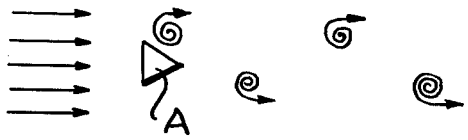
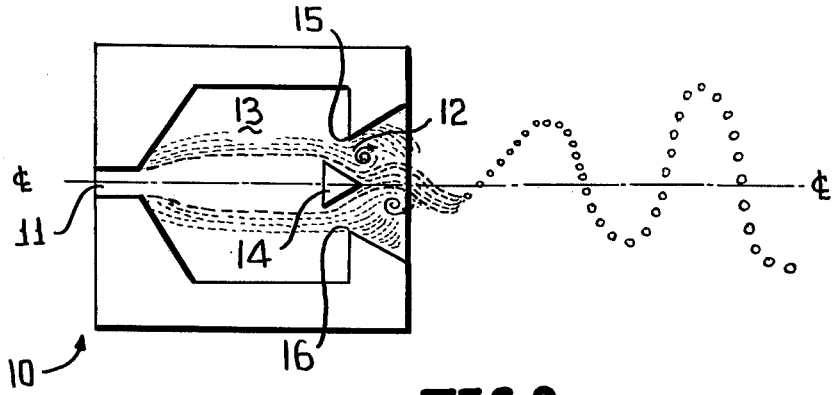
FIG. 2
FIG. 3
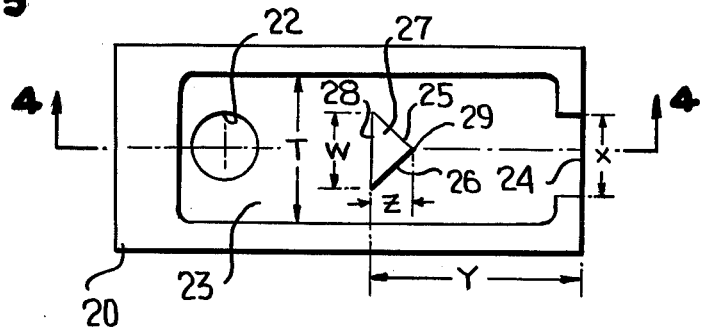
FIG. 4
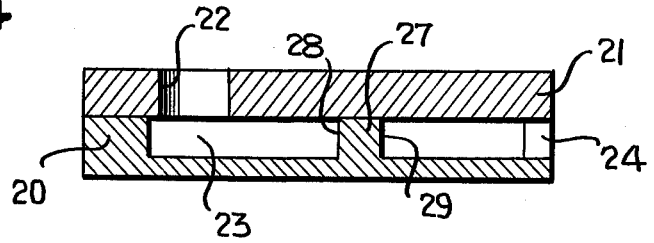

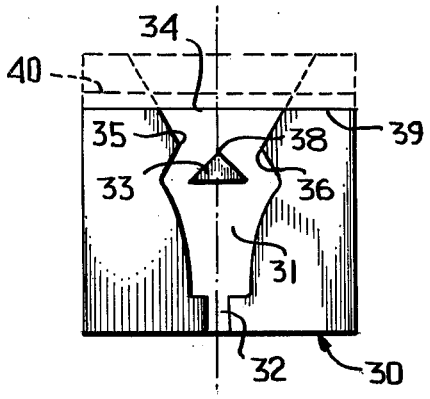
FIG.5
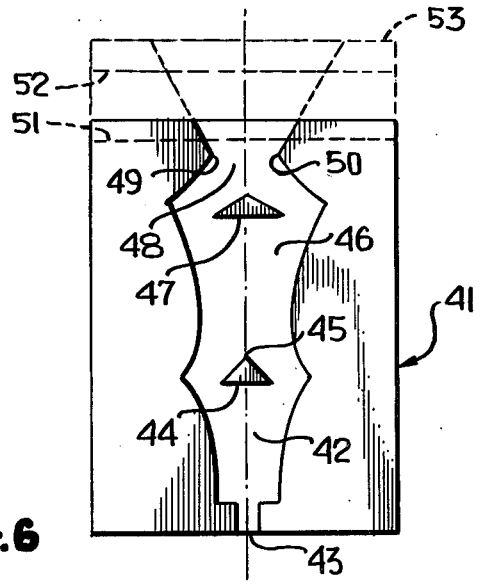
FIG.6
FIG.7
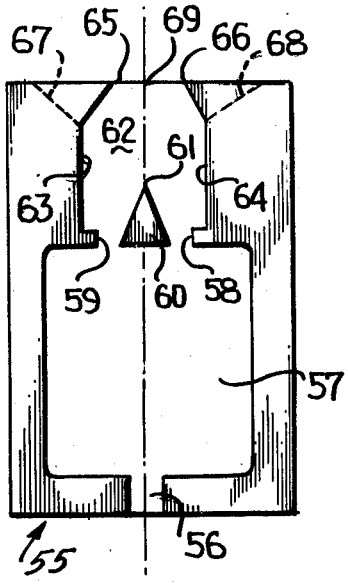
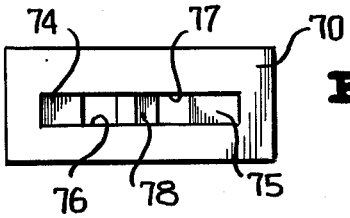
FIG.9
FIG.8
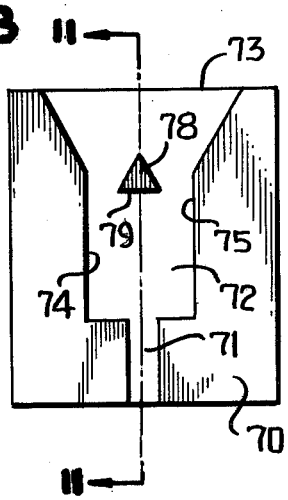
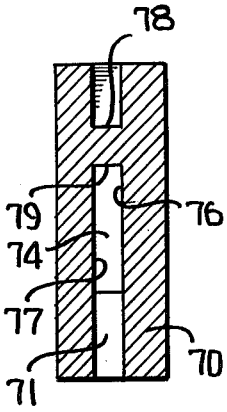
FIG.11
FIG.10
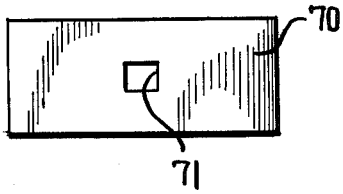

OSCILLATING SPRAY DEVICE

BACKGROUND OF THE INVENTION

The present invention relates to fluid dispersal devices and the like and, more particularly, to such a device of simple and inexpensive construction which requires relatively small fluid pressures to establish various meaningful spray patterns.

Until recently, in order to achieve spray patterns of different desired configurations, one merely shaped an orifice accordingly. Thus, a jet flow could be achieved from a simple small round aperture; a sheet flow could be achieved from a lineal aperture; swirl nozzles could be used to effect conical spray patterns; etc. This nozzle-shaping approach is simple and inexpensive but the resulting nozzles generally require relatively high applied fluid pressures in order to produce useful spray patterns.

A considerable advance in fluid dispersal devices is described in U.S. Pat. No. 4,052,002 to Stouffer et al. Stouffer et al describe a fluidic oscillator arranged to issue a transversely oscillating fluid jet which, because of the oscillation, distributes itself in a fan-shaped sheet pattern residing in a plane. The interaction of a liquid jet with ambient air results in the jet breaking up into droplets of uniform size and distribution along the fan width. The oscillations begin at relatively low applied fluid pressures (on the order of 0.1 psi) so that fluid dispersal may be efficiently effected at low pressures. This fluidic oscillator approach to fluid dispersal is quite advantageous but is limited in that the issued spray pattern is planar and therefore impinges linearly on a target surface. In many applications it is desirable to provide spray patterns of two-dimensional cross-section which cover a two-dimensional area target.

Other approaches to fluidic nozzles, similarly limited to linear target impingement, are found in U.S. Pat. Nos. 3,423,026 (Carpenter); 3,638,866 (Walker); and 3,911,858 (Goodwin). However, these approaches have the additional disadvantage of requiring higher threshold pressures than the Stouffer et al oscillator before a desirable spray pattern can be achieved.

Area or two-dimensional target impingement can be achieved with a fluidic oscillator as described in U.S. Pat. No. 3,820,716 (Bauer). However, in that approach the oscillator itself must be formed in a three-dimensional annular configuration which is more complex and expensive to manufacture than the more familiar planar configuration of fluidic oscillators. Further, the pressure threshold required to produce oscillation is considerably higher in the Bauer oscillator than in the Stouffer et al oscillator.

The present invention is not truly a fluidic oscillator in that it involves use of the phenomenon known as the Karman vortex street. This phenomenon, well known in the field of fluid dynamics (reference: Handbook of Fluid Dynamics, Victor L. Streeter, Editor-in-Chief, McGraw-Hill Book Company, 1961, page 9-6) relates to a pattern of alternating vortices which are shed on opposite sides of an obstacle disposed in the path of a fluid stream. In the prior art, primary concern over vortex streets has been in the area of fluid-dynamic drag wherein the obstacle (e.g. a wing or fin) is to be moved through a fluid medium with minimal disturbance. The present invention makes use of this vortex street phenomenon in an entirely new context to disperse fluids with a greater variety of dispersal patterns than provided by fluidic oscillators yet with all the advantages inherent in fluidic technology.

It is therefore a primary object of the present invention to provide an improved method and an improved device for dispersing fluids.

It is another object of the present invention to provide a fluid dispersal device which, like fluidic oscillators, is simple and inexpensive to manufacture, issues oscillating fluid streams and has no moving parts but, unlike conventional fluidic oscillators, is capable of dispersing fluid over an area target as well as a linear target.

It is another object of the present invention to utilize the vortex street phenomenon to effect fluid dispersal.

SUMMARY OF THE INVENTION

In accordance with the present invention an obstacle is placed in a flat chamber between inlet and outlet openings. A fluid stream entering the chamber through the inlet impinges upon the obstacle, whereupon a vortex street is established between the obstacle and the outlet. Upon issuing from the outlet the stream is cyclically swept back and forth by the vortex street. Depending upon a number of factors, including the area of the outlet and the position of the obstacle relative to the outlet, the issued stream is either a swept jet or a swept fluid sheet, the sheet being disposed generally perpendicular to the plane of the device and being swept in the plane of the device. In the case of the swept jet, the sweeping action causes breakup of the jet into uniformly sized and distributed droplets. In the case of the swept sheet, smaller droplets are formed due to the mutual interaction between two portions of a jet within the region of the device downstream of the obstacle. The vortex street phenomenon may also be used in cascaded stages to increase the sweep angle or it may be used in a fluidic oscillator to effect sheet-forming whereby to permit the fluidic oscillator to achieve area target coverage.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 1 is a diagrammatic representation of a vortex street established by an obstacle interposed in a free fluid stream;

FIG. 2 is a diagrammatic illustration of a fluid oscillator employing the vortex street phenomenon.

FIG. 3 is a plan view of a preferred oscillator according to the present invention;

FIG. 4 is a view in section taken along lines 4—4 of FIG. 3;

FIG. 5 is a partially diagrammatic plan view of another fluid oscillator embodiment illustrating modifications required to effect different operating modes;

FIG. 6 is a partially diagrammatic plan view of a two-stage oscillator embodiment illustrating modifications required to effect different operating modes;

FIG. 7 is a plan view of another oscillator embodiment illustrating another type of modification to effect a different operating mode;

FIGS. 8, 9 and 10 are top, front and rear views, respectively, in plan of another oscillator embodiment according to the present invention;

FIG. 11 is a view in section along lines 11—11 of FIG. 8;

DESCRIPTION OF PREFERRED EMBODIMENTS

Figure 12:
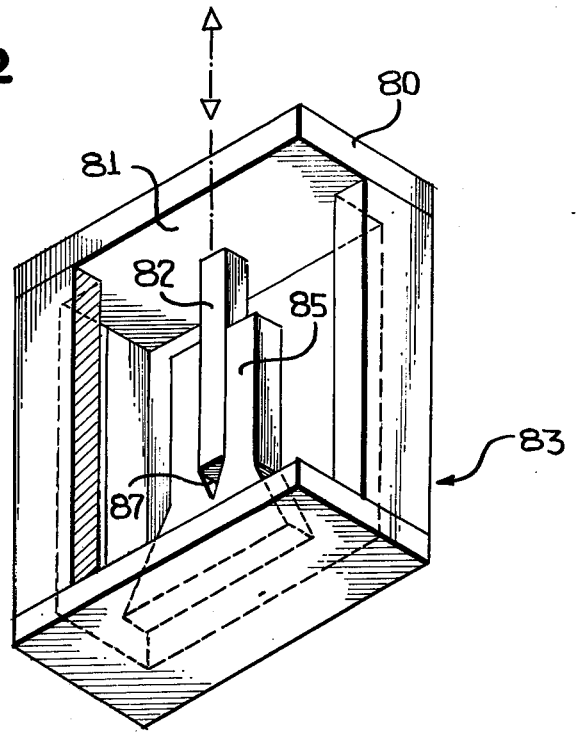
FIG. 12 is a cut-away view in perspective of a plastic mold which may be employed to fabricate the oscillator of FIG. 8.

Referring specifically to FIG. 1, the effect of an obstacle A on a fluid stream is diagrammatically illustrated. Specifically, two rows of vortices are established in the wake of the obstacle, the vortices being formed in periodic alternation on different sides of the obstacle center line. This vortex pattern is called a Karman vortex street or, more familiarly, a vortex street. Vortex streets, their formation and effect, have been studied in great detail in relation to fluid-dynamic drag, particularly as applied to air and water craft. Essentially, when the flow impinges upon the blunt upstream-facing surface of obstacle A, due to some random perturbation slightly more flow will pass to one side (e.g., the top side in FIG. 1) than the other. The increased flow past the top side creates a vortex just downstream of the upstream-facing surface. The vortex tends to back-load flow around the top side so that more flow tends to pass around the bottom side, thereby reducing the strength of the top side vortex but initiating a bottom side vortex. When the bottom side vortex is of sufficient size it back-loads flow about that side to redirect most of the flow past the top side to restart the cycle. The strength of the vortices is dependent upon a number of factors, including: Reynolds number of the stream (the higher the Reynolds number the greater the strength); and the shape of obstacle A. I have discovered that this vortex street phenomenon can be utilized to effect fluid dispersal in the manner illustrated in FIG. 2. For ease in reference, operation of this and ensuing embodiments is described in terms of liquid to be sprayed into an ambient air environment; however, it is to be understood that the present invention works equally well when liquid is sprayed into liquid, or gas is sprayed into gas. Referring to FIG. 2 specifically, an oscillator 10 is shown in the form of a solid block of plastic, metal, or the like, having recesses formed in its top surface. The top surface recesses are sealed by a cover plate (not shown, for purposes of clarity). The recessed areas include a chamber 13 having an inlet passage 11 and outlet 12. An obstacle or island 14 is positioned in the path of a fluid stream passing through the chamber 13 between inlet 11 and outlet 12. Island 14 is shown as a triangle, in plan, with one side facing upstream (i.e. toward inlet 11) and the other two sides facing generally downstream and converging to a point on the longitudinal center CL of the oscillator. Neither the shape, orientation, or symmetry of the island is limiting on the present invention. However, a blunt upstream-facing surface has been found to provide a greater vortex street effect than sharp, aerodynamically smooth configuration, while the orientation and symmetry of the island or obstacle has an effect (to be described) on the resulting flow pattern issued from the device.

The outlet 12 is defined between two edges 15 and 16 which form a restriction proximate the downstream facing sides of island 14. This restriction is sufficiently narrow to prevent ambient fluid from entering the region adjacent the downstream-facing sides of island 14, the region where the vortices of the vortex street are formed. In other words, the throat or restriction between edges 15, 16 forces the liquid outflow to fill the region 12 therebetween and preclude entry of ambient air. The vortex street formed by obstacle 14 causes the stream, upon issuing from body 10, to cyclically sweep back and forth transversely of the flow direction. Importantly, I have observed that a cavitation region tends to form immediately downstream of the island 14. Depending upon the size of this cavitation region and where it is positioned relative to the outlet of the device, the device will produce a swept jet, swept sheet, or a straight unswept jet. More particularly, the two portions of the stream, which flow around opposite sides of the island 14, recombine at the downstream terminus of the cavitation region. If this terminus is sufficiently upstream from the outlet, the two stream portions well within the device, the shed vortices are well-defined, and the resulting jet is cyclically swept by the shed vortices, still within the device. The swept jet then issues in its swept jet form. If, however, the downstream terminus of the cavitation region is close to the outlet, the shed vortices are less well-defined and tend to interlace with one another. This forces the two stream portions to be squeezed into impingement proximate the outlet, the stream portions forming a thin sheet in the plane normal to the plane of the device. The vortices oscillate the sheet back and forth. When the terminus of the cavitation region is outside the device, no vortices are shed and the two stream portions eventually come together beyond the confines of the device. The resulting jet is not oscillated due to the absence of the vortices. Whether a swept jet or a swept sheet, the issued swept stream is swept back and forth parallel to the plane of the drawing. If the fluid is liquid, the sweeping action causes an issued jet to first break up into ligaments and then, due to viscous interaction with air, into droplets which are distributed in a fan-shaped pattern in the plane of the sweeping action. The liquid sheet, because of the sheet-forming phenomenon, breaks up into finer droplets which are similarly swept back and forth.

Figure 39:
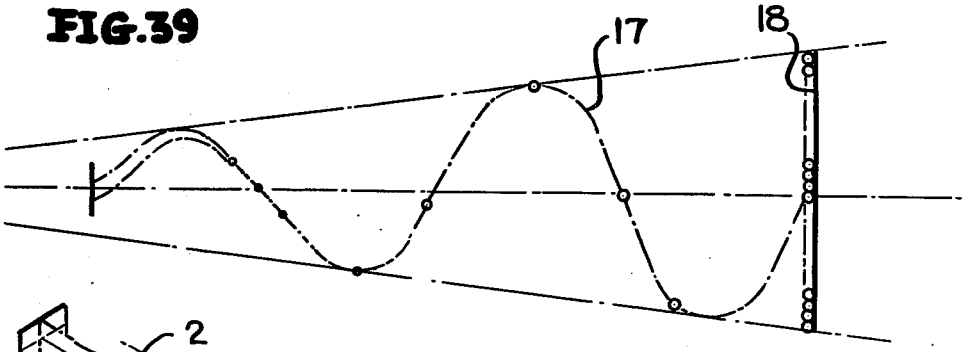
FIG. 39 is a diagrammatic representation of a typical waveform of the flow pattern issued from oscillators of the present invention which operate in the swept jet mode.

A typical swept jet pattern 17 is illustrated in FIG. 39. When viewed normal to the plane of oscillation the pattern appears as a fan; the cross-section taken transverse to the flow direction appears as a line. The representation in FIG. 39 is a stop-action wave form 17 presented for purposes of illustrating the manner in which fluid is dispersed in a plane. In actuality, the spray appears to the human eye as a fan-shaped pattern full of droplets (in the case of liquid) with no discernible waveform. This is because the oscillation frequency is faster than can be perceived by the eye (nominally, at least a few hundred Hertz). when liquid is used as the working fluid, the droplets in the spray pattern, when striking a surface, wet a line 18 across that surface. If the oscillator is moved normal to the direction of flow (i.e. into the plane of the drawing), the spray pattern wets a rectangular target area having a width equal to the length of line pattern 18, leaving a pattern similar to that left by a paint roller as it moves along a wall.

Figure 40:
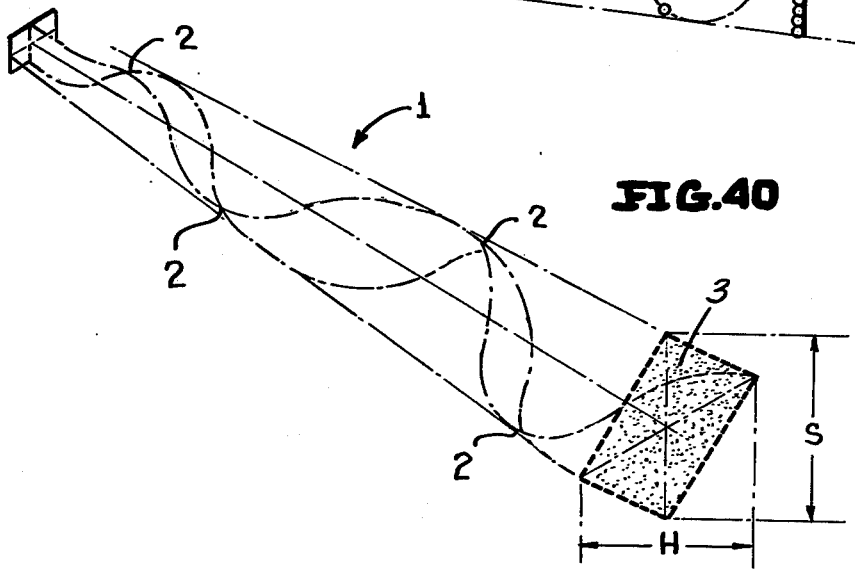
FIG. 40 is a diagrammatic representation of a typical waveform of the flow issued from oscillators of the present invention which operate in the swept sheet mode.
Figure 25:
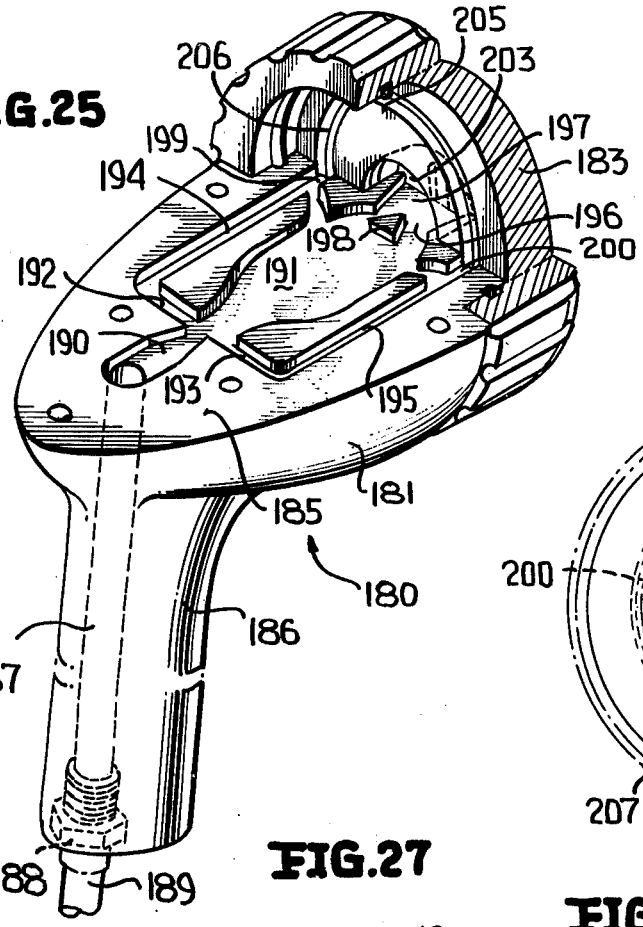
FIG. 25 is a view in perspective, partially broken away, of another oscillator embodiment employed in a shower head.
Figure 26:
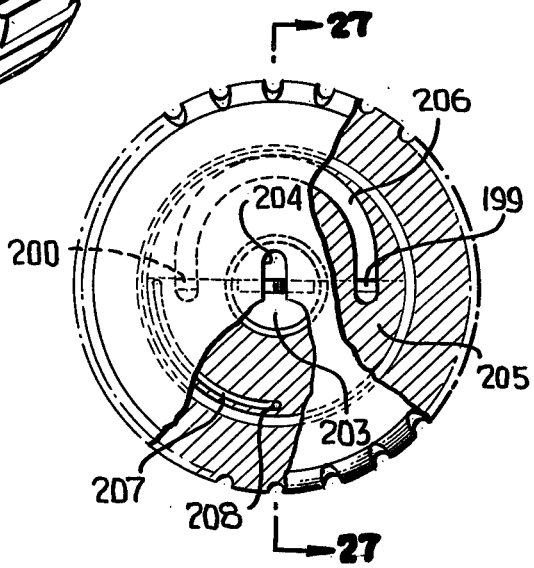
FIG. 26 is a front view of the head portion of the embodiment of FIG. 25.
Figure 27:
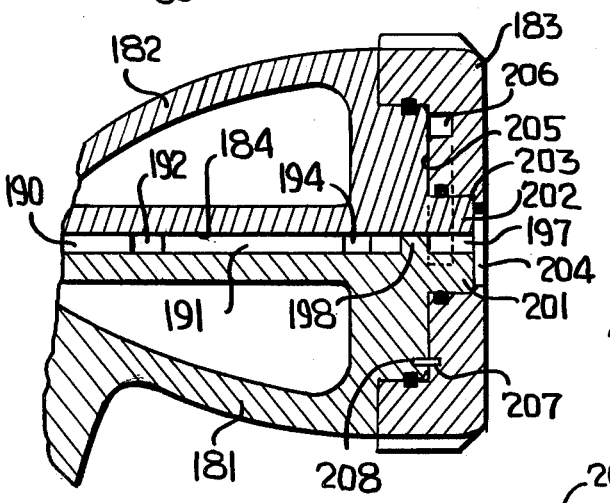
FIG. 27 is a view in section taken along lines 27—27 of FIG. 26.

The area spray 1 is illustrated in FIG. 40 and is, in essence, a sheet of water which resides in a plane normal to the oscillation plane and which is swept back and forth by the oscillation. The height of the sheet (i.e. the dimension normal to the oscillation plane) varies within each oscillation cycle, reaching a minimum at the two extremities 2 of the sweep and a maximum midway between those extremities. The resulting pattern 3 produced on a target surface is diamond-shaped. The diamond width S is dependent upon the sweep angle of the oscillator; the diamond height H depends upon the height of the sheet. For the same size oscillator, and the same operating pressure, the droplets formed in the liquid spray pattern 1 of FIG. 40 are much smaller than the droplets formed from a liquid spray pattern 17 such as in FIG. 39. The reason for this is that the issued jet in the pattern 17 of FIG. 39 tends to remain integral as it leaves the oscillator so that the cyclical sweeping action is the primary breakup or droplet-inducing mechanism. In pattern 1 of FIG. 40, the out-of-plane expansion of the liquid appears to be caused by the two separated flow portions recombining by impinging upon one another proximate outlet of the device. This impingement of itself causes an initial breakup which is further enhanced by the sweeping action.

A typical embodiment of the oscillator of the present invention is illustrated in FIGS. 3 and 4. Two plates 20, 21, made, for example, of plastic material, are of generally rectangular configuration, although this configuration is by no means limiting. Top plate 21 is depicted as clear plastic, and therefore invisible, in FIG. 3 so as to facilitate an understanding of the structure and operation of the oscillator. Top plate 21 and bottom plate 20 are bonded together along their bottom and top surfaces, respectively, by adhesive or the like. An inlet hole 22 for fluid is defined through top plate 21, although such inlet may be defined through plate 20. A generally rectangular recess is defined in the top surface of bottom plate 20, the recess being sealed by top plate 21 to form a chamber 23 into which input fluid may flow through inlet hole 22 at one chamber end. The chamber has an outlet opening 24 defined in the plane of the recess at the other chamber end. The outlet 24 is defined between two opposed edges which are usually spaced by a distance less than the chamber width so that outlet 24 is effectively a flow restrictor. Flow restricting outlet 24 isolates the chamber from ambient pressure under normal operating conditions.

An obstruction 27, in the form of an upstanding island from the floor of chamber 23, is positioned between inlet hole 22 and outlet 24. Obstruction or island 27, as shown, is triangular with one side 28 facing upstream and normal to the flow direction from inlet 22 to outlet 24. The other two sides 25 and 26 meet at an apex 29 which points generally toward outlet 24. This triangular configuration is not the only one which can be used for the island or obstruction in accordance with the principles of this invention. As is described and illustrated herein, the obstruction may be circular, elliptical, rectangular, polygonal, a flat plate, etc. However, from experiments, the triangular configuration appears to provide the best results. Importantly, the obstruction should have a high drag coefficient to facilitate the establishing of a vortex street in its wake and should facilitate merging of the split portions of the stream fairly within the device if sweeping is to ensue. The triangular configuration, when presenting a flat surface to the flow, has a high drag coefficient. In addition, the tapering of converging sides 25 and 26 present a suitable region for the cavitation effect which tends to facilitate vortex formation. The cavitation effect, as described above, aids in drawing the split portions of the stream back together.

In operation, fluid under pressure is admitted into chamber 23 via inlet 22. If the applied fluid pressure is sufficiently high (and this required pressure may be only one psi or less, depending on the size of the oscillator) the fluid fills chamber 23 and a flow stream is established between inlet 22 and outlet 24. Restricted outlet 24 serves to isolate the chamber 23 from ambient air so that ambient air cannot interfere with formation of the vortices in the vortex street. As the flow passes obstruction 27 a vortex street is established between the obstruction and outlet 24. The vortex street causes the flow issued from the outlet to sweep back and forth in the plane of FIG. 3, providing either a pattern 17 of the type illustrated in FIG. 39, or a pattern 1 of the type illustrated in FIG. 40. Which pattern is produced depends to a large extent on the geometry of the device. This can be illustrated by referring to the dimensions shown in FIG. 3 wherein: W is the length of upstream-facing side 28 of island 27; T is the width of chamber 23; X is the width of outlet 24; Y is the distance between side 28 and outlet 24; and Z is the downstream length of island 27. The following discussion assumes that W=0.412 inches; T=1.009 inch, or 2.45 W; Z=0.200 inch, or 0.485 W; and the depth of the recesses in plate 20 is 0.125 inch, or 0.303 W. The unit of FIG. 3 was tested by varying X for Y=2.0 inches, or 4.85 W; for Y=1.33 inches, or 3.23 W; and for Y=0.42 inches, or 1.02 W. The unit was operated with water, at a nominal pressure of 1 to 2 psi, spraying into air.

For Y=4.85 W, the device produced a sweeping jet pattern (pattern 17 of FIG. 39) for all values of X between X=0.9 W to X=T−2.45 W. For values of X below 0.9 W a non-sweeping jet was issued. It was also observed that the angle of the swept jet (i.e. the fan angle) varied from 33° at X=0.9 W to approximately 75° at X≧1.9 W in a curve similar to a logarmithmic curve which assymetrically approached 75° at X=1.9 W and beyond.

For Y=3.23 W, the device produced a swept sheet pattern (pattern 1 of FIG. 40) for all values of X between X≈0.6 W and X=T=2.45 W. For values of X immediately below approximately 0.6 W a jet, swept over a narrow angle, was observed; the jet seemed to increase in thickness (dimension H of FIG. 40) until a discernible sheet appeared at approximately X=0.6 W. Between X=0.6 W and X≈2.0 W the sweep angle (corresponding to dimension S in FIG. 40) increased with X, substantially linearly at first and then with a decreasing slope. A sweep angle of approximately 25° was noted at X=0.6 W and an angle of approximately 80° was noted at X=2.0 W. Between X=2.0 W and X=T=2.45 W the fan angle decreases from approximately 80° to 60° with negatively increasing slope. The angle of the sheet (i.e. the angle in the plane normal to the sweep angle and corresponding to dimension H in FIG. 40) also changes with X. Specifically, this angle increases from 20° at X=0.7 W to approximately 60° at X=1.7 W, and then decreases to about 35° at X=T=2.45 W.

For Y=1.02 W, sweeping was found to occur only in the range from X=1.65 W to X=1.82 W. In that range, the fan angle varied from approximately 25° to approximately 90°; the sheet angle remained constant at 120°. For values of X below 1.65 W a non-sweeping sheet was observed which increased in angle with increasing X. For values of X above 1.82 W the cavitation region was observed to extend outside the device so that two jets, which eventually merged downstream of the device, were issued.

From the test results described in the immediately foregoing paragraphs, it was concluded that:

(1) as the distance of the island 27 from outlet 24 (dimension Y) increases, the tendency toward a sweeping jet mode increases;

(2) as distance Y decreases, the tendency toward a sweeping sheet mode increases;

(3) as the width of outlet 24 (dimension X) increases, the sweep angle tends to increase.

In separate tests it has also been observed that as the depth of the unit, particularly in the region of outlet 24, increases, the tendency toward a sweeping sheet mode increases. In still other tests it has been observed that increases in applied pressure have a tendency to favor a swept sheet mode, although for sufficiently large values of Y there is no sheet formation irrespective of applied pressure. Further, it has been observed that increasing the length of side 28 (dimension W) has a tendency toward providing a swept sheet operating mode.

FIG. 5 diagrammatically illustrates some of the parameters which determine whether the pattern issued from the oscillator is a swept jet or a swept sheet. For simplicity in description and understanding, only a bottom plate is illustrated for oscillator 30 of FIG. 5. As with other embodiments to be described herein, it is understood that the oscillator is actually formed by two or more plates so that proper sealing is effected, or is formed in a monolithic structure as described in relation to FIG. 12. Oscillator 30 of FIG. 5 includes a chamber 31 having an inlet 32, outlet 34 and triangular obstruction 33 interposed in the flow path between the inlet and outlet. Inlet 32, unlike out-of-plane inlet hole 22 of FIG. 3, is provided in the form of a passage or nozzle in the plane of chamber 31; either inlet approach is suitable. Chamber 31, rather than being rectangular, has sidewalls which diverge until reaching a downstream location proximate obstruction 33 at which point they converge toward opposed edges 35, 36. In this embodiment edges 35, 36 are shown approximately aligned with or slightly downstream of the obstruction apex 38. The outlet region 34 is defined between sidewalls which once again diverge from edges 35, 36.

If the outlet region is cut-off at 39 as shown by the solid line in FIG. 5, or at any point between solid line 39 and dotted line 40, the oscillator operates in the swept sheet mode typified by the waveform of FIG. 40. If the outlet is extended, or cut off downstream of dotted line 40, a swept jet or fan mode ensues, as typified by the waveform of FIG. 39. If the outlet region is cut off upstream of solid line 39 (i.e.—closer to obstruction 33), oscillation tends to be unstable and may terminate altogether because of the likelihood that ambient air will prevent the formation and shedding of vortices required for the vortex street.

Referring to FIG. 6 of the accompanying drawings, there is illustrated a two-stage oscillator 41. Oscillator 41 includes a chamber 42 which receives pressurized fluid from an inlet 43. An obstruction or island 44 of generally triangular configuration is disclosed in chamber 42 somewhat downstream of inlet 43 and in the path of fluid flowing through chamber 42. The sidewalls of chamber 42, as was the case with chamber 31 in FIG. 5, diverge gradually from inlet 43 until reaching a downstream location approximate the obstruction 44 whereupon they begin to converge. Unlike the sidewalls in oscillator 30, however, the sidewalls in oscillator 41 do not form a restriction proximate the apex 45 of island 44 but instead curve and begin to diverge to form a second chamber 46 downstream of obstruction 44. Although somewhat wider than chamber 42, chamber 46 is similar in configuration to chamber 42 and includes an obstruction or island 47 of generally triangular configuration. The sidewalls of chamber 46, which diverge until reaching the downstream location proximate island 47, begin to converge thereafter to form an outlet throat 48 between the two opposed edges 49 and 50. Outlet throat 48 is disposed somewhat downstream of island 47, and the sidewalls beyond the outlet throat begin to diverge somewhat. I have found that by adding a second chamber 46 and obstruction 47 I am able to achieve an enhanced or amplified oscillation. More specifically, the second island 47, placed in the wake or vortex street produced by the first island 44, produces an amplified vortex street which causes the swept flow issued from outlet 48 to be swept at a greater angle than is achieved by a single-stage device. In other words, the fan spray pattern has a wider angle when a two-stage device is employed and the sheet spray pattern covers a wider sweep area when a two-stage device is employed.

The second stage has an additional effect, namely, it permits the outlet region to be cut off much closer to the restricted outlet throat 48 and still achieve oscillation than is possible with a one-stage device. This feature is diagrammatically illustrated by the dotted lines in FIG. 6. More specifically, I have found that cutting off the outlet region between dotted lines 52 and 53 produces the swept jet flow pattern characterized in FIG. 39. Cutting off the outlet region in the area between dotted lines 51 and 52 results in the full coverage or area spray characterized by FIG. 40. Cutting off the outlet region upstream of dotted line 51 results in unstable or no oscillation. It is noted that dotted line 51 in FIG. 6 is much closer to the restricted outlet than is solid line 39 of FIG. 5. Both of these lines demark the region upstream of which a cutoff outlet region produces unstable or no oscillation. The second stage addition in FIG. 6 markedly increases the flexibility as to where the cutoff may occur and still achieve oscillation. The reason for this is that oscillation is not dependent upon the second stage obstruction 47 but rather is initially begun by obstruction 44. As the primary oscillation inducing mechanism, obstruction 44 is relatively far removed from the outlet of the device so that the vortices shed by obstruction 44 are not readily affected by cutting the outlet close to obstruction 47. The second stage obstruction 47 merely amplifies or enhances the oscillation produced by the first stage island.

The importance of using island 47 as a second stage goes beyond cascading two vortex shedding devices. More particularly, the first stage may be a conventional fluidic oscillator or any device which causes a jet to oscillate or be swept back and forth. Directing such an oscillating jet into region 46 permits island 47 to enhance the oscillation and provide a greater sweep angle in the issued jet. This feature is more fully illustrated in FIGS. 20 and 21 which are described below. Alternatively the second stage may be combined with any oscillator for the purpose of converting a sweeping jet to a sweeping sheet as described in relation to FIG. 19.

Another embodiment of the present invention is illustrated as oscillator 55 in FIG. 7. Oscillator 55 includes an inlet passage 56 to a generally rectangularly shaped chamber 57. An outlet passage from chamber 57 is aligned with inlet 56 and defined between two opposed edges 58 and 59. A triangular shaped obstruction 60 is positioned with its blunt upstream-facing end between edges 58 and 59 and with its apex 61 extending beyond edges 58 and 59 into a second chamber 62. Chamber 62 has opposed sidewalls 63 and 64 which are initially set back from edges 58 and 59 and extend in parallel fashion to a point downstream of apex 61 after which they begin to converge to form opposed edges 65 and 66. The space between edges 65 and 66 defines an outlet throat 69 for the oscillator 55.

The structure as described and shown in solid lines in FIG. 7 provides a full coverage or area spray of the type characterized by the wave pattern in FIG. 40. If, however, the converging sections of sidewalls 63 and 64 are removed and instead the sidewalls are cut to diverge as shown by dotted lines 67 and 68, the flow pattern issued from oscillator 55 is a swept jet rather than a swept sheet. The reason for this is not fully understood. It is theorized, however, that the restriction provided by edges 65 and 66 acts to move the point of vortex formation downstream, thereby having an effect similar to that obtained by moving the island 60 closer to the outlet throat 69.

Referring now to FIGS. 8, 9, 10 and 11, there is illustrated an embodiment according to the present invention which may be formed as a monolithic structure. Specifically, the oscillator is formed in a common block 70 and includes a chamber 72, inlet 71, and outlet 73, all formed coplanar with one another. Inlet 71 is a flow passage communicating substantially centrally through one end wall of chamber 72. The two sidewalls 74 and 75 of the chamber are set back from inlet 71 and extend downstream in a substantially parallel relationship for a predetermined distance beyond which they diverge to form outlet region 73. The oscillator is sealed top and bottom by top wall 77 and bottom wall 76, respectively. An obstruction 78 of generally triangular configuration is disposed in alignment with inlet passage 71. The blunt upstream-facing side 79 of the obstruction is approximately the same width as inlet passage 71 in this embodiment, and is located just upstream of the point where the two sidewalls 74 and 75 begin to diverge. The apex of obstruction 79 is positioned slightly downstream of the point where the sidewalls begin to diverge. It is to be understood, however, that the distance of obstruction 78 downstream of inlet 71 is not critical to this embodiment in that such distance can be made extremely short or long without affecting operation.

Operation of the embodiment illustrated in FIGS. 8—11 proceeds in the manner described previously for other embodiments. Using FIG. 7 as an example, since the outlet region 73 has diverging sidewalls 74 and 75, the issued flow takes the form of a swept jet rather than a swept sheet. It should be understood, however, that the diverging portion of walls 74 and 75 can be eliminated and even be rendered slightly convergent if it is desired to construct this embodiment in a manner which will produce a swept sheet operating mode. Moreover, locating the island 78 closer to outlet 73 also provides for swept sheet operation.

Referring specifically to FIG. 12, there is illustrated a two-piece core for forming the monolith oscillator structure of FIGS. 8—11. More specifically, the molding apparatus includes a first piece 80 in the form of a plate with a stem 82 of rectangular cross-section projecting from a surface 81 thereof. The second piece 83 is in the form of a generally hollow rectangular box which is open at one end at which plate 80 serves as a cover with stem 82 projecting into the box. A bifurcated projection 85 extends inwardly from the other end wall of piece 83. The shape of projection 85 exactly matches the chamber 72 illustrated in FIG. 8. The bifurcation in projection 85 has a cross-sectional configuration which matches the cross-sectional configuration of stem 82 (and of the inlet passage 71 in FIG. 8). The innermost part 87 of the bifurcation tapers to form a triangular shape identical to that of obstruction 78 of FIG. 8. When stem 82 of piece 80 is inserted into the bifurcation, it completely fills the bifurcation, except for the triangular portion 87. If molten plastic is injected into the interior of piece 83 and allowed to harden, the resulting formed structure is that of oscillator 70 in FIG. 8. This simple two-piece mold permits quick and inexpensive fabrication for mass production purposes.

Still another embodiment of the present invention is illustrated in FIG. 13 and 14, again it being understood that the top plate normally provided to seal the top of the oscillator passages is omitted for purposes of clarity. In this particular embodiment the oscillator 90 has an inlet opening 91 defined through the bottom plate. Inlet opening 91 feeds the power nozzle 92 which opens into the upstream of interaction region 93. The power nozzle 92 and interaction region 93 are substantially coplanar and are defined in the upper surface of the bottom plate of the oscillator. In this particular embodiment the sidewalls 94 and 95 of the interaction region are considerably set back from the power nozzle 92 to provide a substantially wider interaction region than most of the oscillators herein described. The set back sidewalls 94 and 95 extend substantially parallel to one another to a point upstream where they approach one another along a common line whereby to define edges 96 and 97 opposed to one another. The region between the edges 96 and 97 serves as an opening to an outlet region 98 wherein the sidewalls 101 and 102 diverge. An obstruction 100 in the form of a triangle of the type previously described has its blunt flat surface 99 facing upstream and located slightly upstream of the edges 96 and 97. The rearward apex 103 of obstruction 100 is disposed generally between edges 96 and 97 in substantial alignment therewith.

Figure 13:
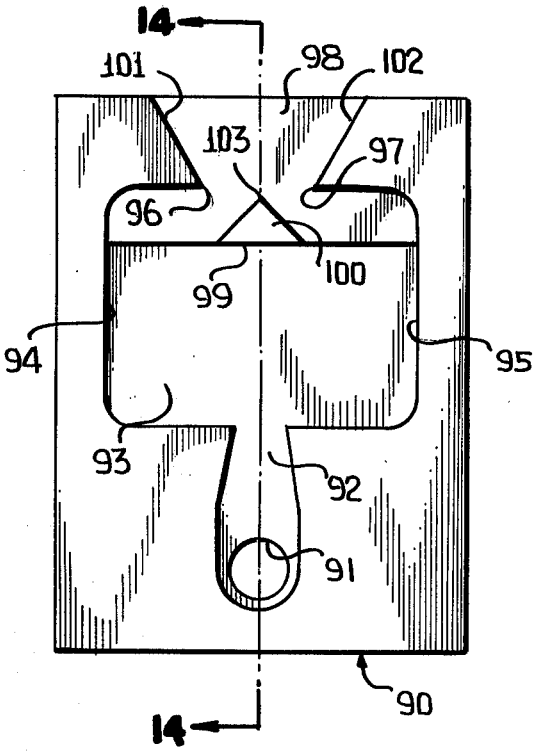
FIG. 13 is a plan view of another oscillator embodiment.
Figure 14:
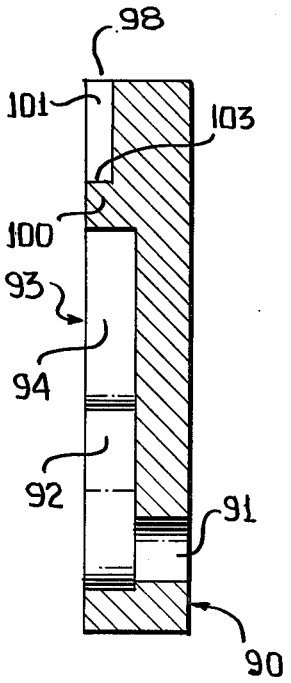
FIG. 14 is a view in section along lines 14—14 of FIG. 13.

A key feature of oscillator 90 is the fact that the portion of the oscillator upstream of blunt surface 99 of obstruction 100 is deeper (i.e.—it is formed deeper in the bottom plate) than the portion of the oscillator downstream of that surface. The shallower downstream end has been found to cause the device to operate in a swept sheet mode (as per FIG. 40) rather than the swept jet mode (as per FIG. 39). In other words, it has been observed that by making the outlet region and the downstream part of the chamber shallower than the rest of the oscillator the effect is the same as providing the restriction 65 and 66 in FIG. 7; or decreasing the dimension Y in FIG. 3; that is, a swept sheet tends to be formed as opposed to a swept jet. If oscillator 90 is constructed without the different depth sections but having the same overall plan arrangement, swept jet operation is the normal mode. It is important to note that the change in the depth of the oscillator need not be in a discrete step as illustrated in FIGS. 13 and 14; rather, the depth can be tapered so that it gradually narrows from the upstream toward the downstream end. In a typical embodiment, operating in the swept sheet mode, the upstream end of the oscillator is 0.063 inches deep whereas the downstream end is 0.033 inches deep. The distance between side-walls 94 and 95 is 0.9 inches whereas the distance between the opening of power nozzle 92 into chamber 93 and the blunt surface 99 of obstruction 100 is 0.45 inches. Power nozzle 92 is 0.185 inches wide, the spacing between edges 96 and 97 is 0.375 inches wide, and the shortest distance between edge 96 and the obstruction 100 (and between edge 97 and obstruction 100) is approximately 0.155 inches. If the platform is removed so that the entire unit is of a uniform depth, the entire depth is that of the upstream end of the oscillator, namely 0.63 inches and the swept jet mode is achieved. It is to be understood that these dimensions are by way of providing an example of a typical working model. The dimensions may vary considerably to produce different effects and sweeps of different amplitudes. The important aspect of the invention is the utilization of an obstruction to produce a vortex street in a body so that upon issuance from that body a fluid stream is caused to oscillate and be dispersed evenly in either a sheet or a jet form.

Figure 15:
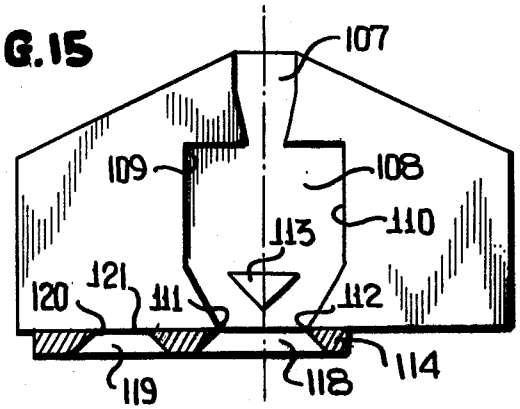
FIGS. 15, 16 and 17 are top, rear and bottom views, respectively, in plan of a two-mode oscillator set to operate in one mode.
Figure 16:
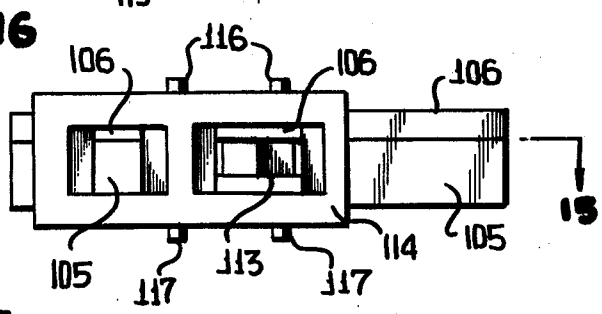
Figure 17:
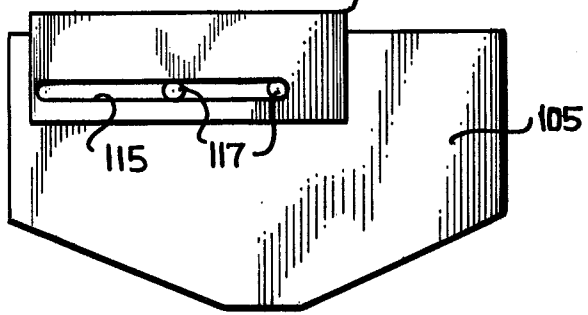

Referring now to FIGS. 15, 16 and 17 of the accompanying drawings, there is illustrated an oscillator embodiment which can be manually adjusted to provide either a swept jet or a swept sheet flow pattern. Specifically, the oscillator includes a bottom plate 105 and a top plate 106. The oscillator itself is defined in the upper surface of bottom plate 105 so that top plate 106 serves as a sealing plate for the oscillator. The oscillator as formed includes a power nozzle 107 which feeds a chamber 108 with a stream of pressurized fluid. Chamber 108 includes sidewalls 109 and 110 which are set back from the power nozzle 107 and extend from the upstream end of the chamber in substantial parallelism. At a location downstream of the power nozzle the sidewalls 109 and 110 begin to converge toward one another until reaching the end of plate 105 where they define opposed edges 111 and 112. The space between edges 111 and 112 constitutes the outlet opening for the chamber 108. A substantially triangular obstruction 113 is positioned between power nozzle 107 and the outlet opening in the region where the sidewalls 109 and 110 converge.

A control device 114 having a generally U-shaped cross-section configuration fits over the downstream end of the blocks 105, 106 with the base portion of the U-shape abutting the plane of the outlet opening and with the legs of the U-shape extending along the top of plate 106 and bottom of plate 105. A pair of studs 116 extend upwardly from the top surface of plate 106; a similar pair of studs 117 extend downwardly from the bottom surface of plate 105. Each of the legs of U-shaped control member 114 is provided with a slot 115 through which the studs 116, 117 extend to engage member 114. Slot 115 extends transversely of the direction of flow in the oscillator, and likewise studs 117 (and studs 116) are transversely spaced. Slot 115 is substantially longer than the spacing between studs 117 (and studs 116) so that the control member may be slid back and forth until each of studs 117 (and studs 116) abuts a different end of the slot 115. In the position shown in FIGS. 15–17, the control member 114 is in one extreme position relative to the body of the oscillator.

The base of the U-shaped control member 114 includes two openings 118 and 119. These openings have a height (in the dimension perpendicular to the point of oscillation, as best seen in FIG. 16) which is greater than the depth of the oscillator. The width of opening 118 (in the plane of oscillation) is greater than the width of opening 119, the two openings being spaced from one another such that for one extreme position of control member 114 relative to studs 116, 117, opening 118 is centered over the outlet opening of the oscillator. For the other extreme position of control member 114 opening 119 is centered over the outlet opening of the oscillator.

Figure 18:
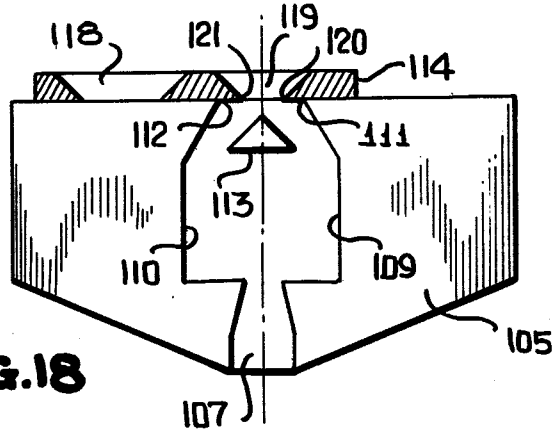
FIG. 18 is a top view in plan of the oscillator of FIG. 15 set to operate in its second mode.

The spacing between edges 111 and 112 (and therefore the width of opening 118), and the spacing of obstruction 113 relative to the outlet opening, are chosen to provide swept jet operation (as per FIG. 39). Therefore, when control member 114 is positioned as illustrated in FIGS. 15–17, the swept jet operating mode is achieved. However, in the other extreme position of slidable control member 114, as illustrated in FIG. 18, the width of the outlet is considerably reduced by opening 119. The width of outlet 119 is chosen, in combination with the spacing of island 113 therefrom, to effect swept sheet operation as per FIG. 40.

Figure 19:
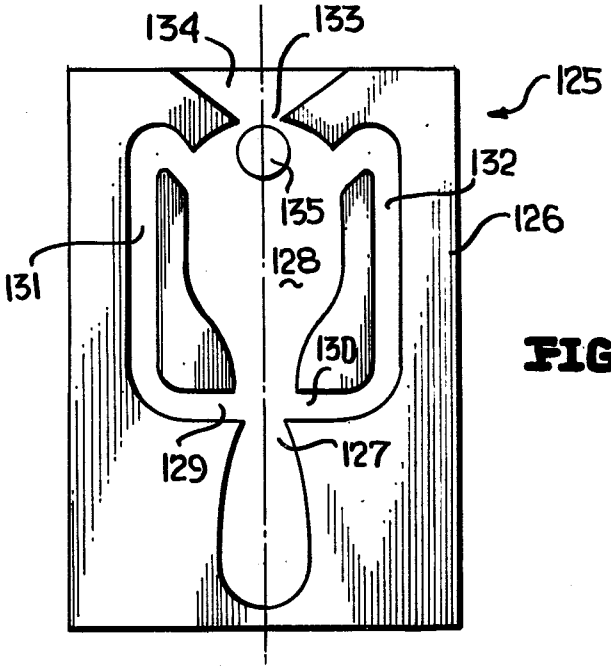
FIG. 19 is a plan view of another oscillator embodiment.

Another embodiment of the present invention is illustrated in FIG. 19. In this embodiment a fluidic oscillator has its operation enhanced by means of an island. Specifically, an oscillator 125 includes a bottom plate 126 and a top plate (not shown to preserve clarity). A power nozzle 127 receives pressurized fluid and issues a jet into interaction region 128. Immediately downstream of power nozzle 127 there are control ports 129 and 130 disposed on opposite sides of the power nozzle and take the form of openings defined in the sidewalls of interaction region 128. A pair of feedback passages 131 and 132 are disposed to receive fluid at opposite sides of the downstream end of the interaction region and to feed the received fluid back to control ports 129 and 130, respectively. The sidewalls of the interaction region 128 converge beyond feedback passage entrances to form an outlet throat 133. An outlet region 134 extends downstream of throat 133 and is defined between two sidewalls which diverge from the throat. An island, or obstruction, 135 is positioned in the interaction region 128 proximate throat 133 and in alignment between the throat and power nozzle 127. Island 135 is circular in section, rather than triangular, but could also be triangular for purposes of the present invention.

Apart from island 135, oscillator 125 is a conventional fluidic oscillator in which the jet issued from power nozzle 127 is oscillated back and forth between the sidewalls of interaction region 128 by the jet fluid which is alternately fed back through feedback passages 131 and 132. Such oscillators are well known and are typified by the oscillators described in U.S. Pat. No. 3,432,102 to Turner. Without island 135 present, oscillator 125 would issue a sweeping jet. However, island 135, located close to throat 133, produces a swept sheet operating mode.

Thus it seems that the vortex shedding principle employed in the present invention is not only useful to initiate oscillation, it can be used to enhance oscillation in an otherwise oscillated jet (as per FIG. 6); and it can be used to convert a swept jet, no matter how the sweeping is initiated, to a swept sheet.

Figure 20:
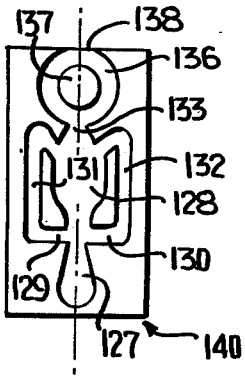
FIG. 20 is a plan view of another oscillator embodiment.

Another embodiment of the present invention is illustrated in FIG. 20 and again employs the vortex shedding principle of the present invention in conjunction with a conventional fluidic oscillator. For convenience in reference the same fluidic oscillator illustrated in FIG. 19 is illustrated in FIG. 20 and corresponding parts bear the same reference numerals. The difference resides in the fact that in oscillator 140 of FIG. 20 the island 137 has been moved out of interaction region 128 to the outlet region immediately downstream of throat 133. In addition, the outlet region 136 is configured generally circular, rather than divergent, in a manner to be substantially concentric about the circular island 137. The inlet to the outlet region 136 is throat 133; the outlet from region 136 is a similar throat 138 disposed diametrically across region 136 from throat 133. As with oscillator 125, the effect of the island in oscillator 140 is to convert the fluidically-swept jet to a swept sheet. One difference has been noted in the resulting sheet, however. In oscillator 125 the frequency of the fluidic oscillation is the only frequency observed; whereas in oscillator 140 both the fluidic frequency and the characteristically higher frequency of the vortex-shedding phenomenon are observed. It is concluded, therefore, that whereas island 135 in oscillator 125 acts only to convert the jet to the sheet and does not impart any oscillatory effect of its own, island 137 in oscillator 140, on the other hand, imparts oscillatory or sweeping effect in addition to converting the jet to a sheet. The reason for this difference is not fully understood. However, the difference in effect has some practical importance. The characteristically lower fluidic frequency is in the range wherein it is sensed in vibrations by the human body and similarly responding targets. The much higher frequency produced by the vortex-shedding mechanism is barely, if at all, sensed as a vibration by the human body in the swept sheet mode in which the spray strikes the target over a large area. In some cases, such as massaging showers or oral irrigators, it may be desirable to have the vibrations sensed, whereby oscillator 125 is more appropriate. In other applications, such as non-massaging showers, hair or deodorant sprays, etc., the sensed vibrations may not be desirable and therefore oscillator 140 is more appropriate.

Figure 21:
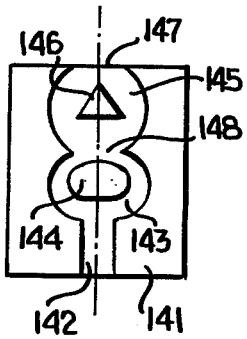
FIG. 21 is a plan view of another oscillator embodiment.

Another two-stage device 141 is illustrated in FIG. 21. Specifically, oscillator 141 has an inlet passage 142 by which fluid is conducted into an elliptical region 143 having its major axis disposed transverse to the inflowing fluid. A generally similar elliptical island 144 is disposed in region 143 and is substantially wider along its major axis than the width of inlet passage 142. An outlet throat 148 from region 143 is diametrically opposed to inlet 142 and also serves as an inlet for a second region 145. Region 145 is characterized by sidewalls which first diverge from throat 148 and then converge to form an egress throat 147 for the oscillator. A triangular island 146 (which may also be circular or any other island shape described herein) is disposed in chamber 145 between throats 148 and 147. Oscillator 141 operates in a manner similar to the two-stage island device of FIG. 6 to provide enhancement of oscillation in the second stage. In the particular configuration shown, island 146 is positioned sufficiently proximate egress throat 147 to provide swept sheet operation.

Figure 22:
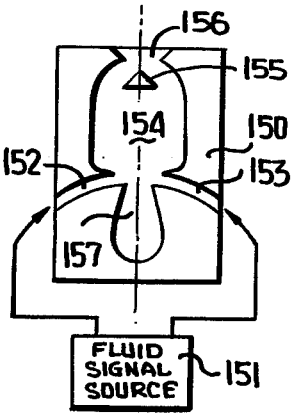
FIG. 22 is a plan view of another oscillator embodiment.

Another embodiment of the present invention is illustrated in FIG. 22. Specifically, device 150 has a power nozzle 157 which delivers pressurized fluid to interaction region 154. Control passages 152 and 153 communicate with interaction region 154 at the upstream end thereof on opposite sides of power nozzle 157. The sidewalls of the interaction region extend substantially parallel downstream of the control passages and then converge to form an outlet throat 156 at the downstream end of region 154. An island or obstruction 155 is positioned in region 154 at a distance from throat 156 which produces the desired swept jet or swept sheet mode in accordance with the considerations described in relation to FIG. 3. It is to be understood that the sidewalls of the interaction region in this and all other embodiments can be configured to initially diverge, rather than be parallel, before converging to define an outlet throat. A fluid signal source 151 is connected to supply alternating fluid pressure or flow signals to control passages 152 and 153. Source 151 may be a conventional fluidic oscillator, a shuttle valve, etc.

A fluid jet issued from power nozzle 157 is cyclically swept by island 155 and issued from throat 156 as a swept jet or swept sheet in accordance with the vortex-shedding phenomenom and principles described above. The alternating fluid flow or pressure applied from source 151 through control passage 152 and 153 is at a lower frequency and acts to modulate the higher frequency jet swept by island 155. The modulation can be used to provide massaging or other sensed-vibration effects, or it can be used in fluid signal processing systems.

Figure 23:
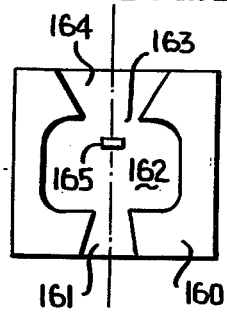
FIG. 23 is a plan view of another oscillator embodiment.

Another embodiment of the invention is illustrated in FIG. 23. An oscillator 160 includes an inlet nozzle 161 which delivers fluid under pressure into a region 162. The sidewalls of region 162 are set back considerably from nozzle 161 (as they may be in any of the other embodiments described herein) and extend parallel to one another until reaching the downstream end of region 162 where they abruptly come together or converge to form egress throat 163. An outlet region 164 is disposed downstream of throat 163 and is defined between two walls which diverge from throat 163. An island or obstruction 165 is in the form of a thin rectangular plate having its broad side facing upstream and its thin side extending in the flow direction. Island 165 is disposed between nozzle 161 and throat 163 at a distance from the throat which is determined by the considerations discussed above in relation to FIG. 3. Oscillator 160 operates in the same manner as the oscillator of FIG. 3 with island 165 shedding vortices to establish a vortex street which cyclically sweeps the resulting jet or sheet. I have found, however, that thin rectangular island 165 tends to be less stable in its sweeping action than the triangular island. It is my belief that the reason for this is that the downstream sides (for example, sides 25 and 26 in FIG. 3) tend to isolate the alternately generated vortices from one another whereas no such sides are present in island 165. Consequently, the vortices generated by island 165 tend to interfere with one another and the resulting sweeping of the jet is less stable.

Figure 24:
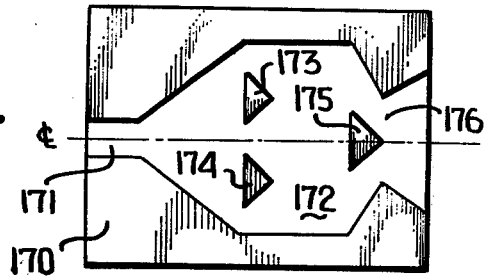
FIG. 24 is a plan view of another oscillator embodiment.

Still another embodiment of the present invention is illustrated in FIG. 24. Oscillator 170 includes an inlet 171, interaction region 172, and outlet 176 as in previously-described embodiments. Oscillator 170 is characterized, however, by three islands 173, 174 and 175. Islands 173 and 174 are identical in shape and are disposed side-by-side on opposite sides of the center line CL of the device. Island 175 is disposed symmetrically on the center line CL and downstream of islands 173, 174. Each of islands 173 and 174 tends to produce an oscillation in the flow, both oscillations being in phase. That is, when the majority of the flow around island 173 is around the bottom edge of its leading face, the majority of the flow around island 174 is likewise around the bottom edge of its leading face, and vice versa. The effect is to broaden the oscillating jet stream which is then directed toward downstream island 175. The position of the latter relative to outlet 176 determines whether the issued spray pattern is a swept jet or swept sheet (as per the considerations discussed in relation to FIG. 3). The broadening effect provided by dual islands 173, 174 has been found to provide a greater tendency toward the swept sheet mode rather than the swept jet mode, again depending upon the position of island 175 relative to throat 176.

As a general rule, for all of the two-stage devices described herein, the upstream stage primarily determines oscillation frequency and stability; the downstream island determines whether the issued spray is a swept jet or swept sheet.

An adjustable mode shower embodiment of the present invention is illustrated in FIGS. 25 through 29, although it is to be understood that the principles described in relation to this embodiment are not limited to showers but apply as well to any spray or fluid dispersal application. The shower includes a top head member 182, a bottom head member 181 and an adjustable control member 183. Top head member 182 has a flat bottom surface 184 which abuts flat top surface 185 of the bottom member to seal an oscillator defined in surface 185. Control member 183 is rotatably secured to the front face of the head, as defined by member 181 and 182, for rotation about an axis substantially coincident with the oscillator longitudinal centerline.

Bottom member 181 has a depending handle portion 186 through which a flow passage 187 extends. Flow passage 187 is adapted to connect to a fitting 188 for a hose 189 which applies pressurized water to the passage. Water so supplied is delivered to the power nozzle 190 of the oscillator defined as recesses in the surface 185. The oscillator is basically similar to oscillator 125 of FIG. 19 in that it includes an interaction region 191, control ports 192, 193, feedback passages 194, 195, outlet throat 196 and outlet region 197. However, instead of a circular island, a triangular island 198 is provided. Furthermore, the feedback passages 194, 195 are provided with additional passages 199, 200, respectively, which extend from the feedback passages downstream to the forward face or end of bottom member 181. In addition, the outlet region is formed as part of a semi-cylindrical member 201 which projects forwardly of the forward faces of head members 181, 182. Likewise, a semi-cylindrical member 202 projects forwardly of the head members to provide a sealing surface for outlet region 197. The two semi-cylindrical members 201, 202 form a cylinder which projects forwardly of the head members.

Control member 183 is generally cylindrical in shape and has two concentric recesses 203, 205 of different depths defined in its rear surface. The innermost recess 203 is sized to receive the cylindrical projection formed by members 201 and 202. An outlet slot 204 of generally rectangular shape is defined through recessed portion 203 and overlies the outlet region 197 of the oscillator. It is to be noted that as control member 183 is rotated relative to head members 181, 182, rectangular slot 204 changes orientation from coplanar with outlet region 197 to perpendicular to that region. The length of slot 204 is substantially the same as the width of outlet region 197 at its downstream end.

Recess 205 in control member 183 is disposed flush with the forward or downstream faces of head members 181, 182. An arcuate channel 206 is defined in recess 205 and subtends an angle of slightly greater than 180°. The extremities of channel 206 are spaced by the same spacing as between passages 199 and 200 at the forward face of head member 181. Therefore, for at least one rotational position of control member 183, passages 199 and 200 are interconnected by channel 206; for at least one other rotational position there is no overlie of either passage 199, 200 by channel 206. A further arcuate channel 207 is likewise defined in recess 205 and is positioned to engage a limit pin 208 which projects from the forward face of lower head member 181. Channel 207 subtends a nominally 90° arc about the axis of rotation for control member 183 and combines with pin 208 to define the extreme rotational positions of the control member. In one extreme position, illustrated in FIG. 26, channel 206 directly interconnects passage 199 and 200, and slot 204 is oriented perpendicular to the plane of outlet region 197. In the other extreme position, illustrated in FIG. 28, channel 206 does not communicate with either passage 199 or 200, and slot 204 is co-planar with outlet region 197. For intermediate positions slot 204 is oriented at various angles between 0° and 90° relative to region 197.

In the embodiment shown the control member 183 is secured to head members 181, 182 by force fitting the control member over the forward ends of the head member, with various O-rings interposed between the control member and head members for sealing purposes. Of course, other methods of rotational securing may be employed.

Figure 28:
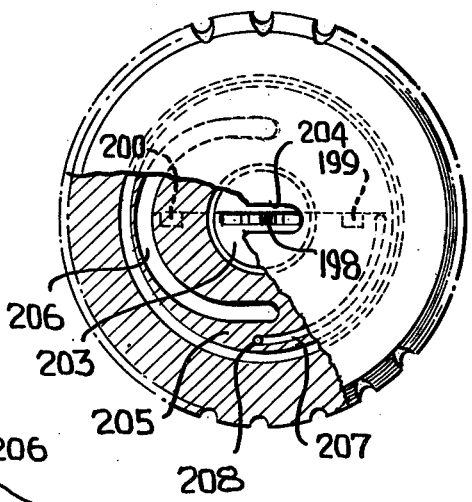
FIG. 28 is a front view similar to FIG. 26, showing the shower head in a different operating mode.
Figure 29:
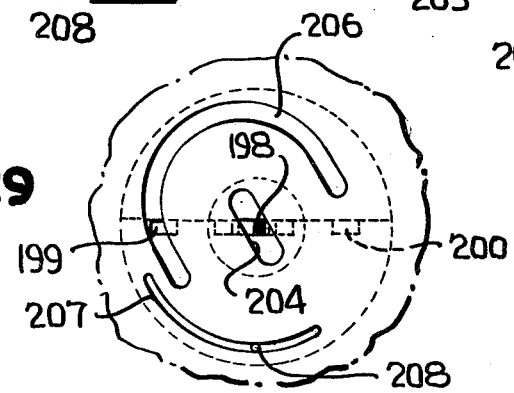
FIG. 29 is a diagrammatic representation of the operation of the shower head of FIGS. 25-28.

In operation, assume that control member 183 is positioned as shown in FIG. 28. Channel 206 does not interconnect the passages 199, 200 so that the feedback operation required for the fluidic oscillator effect is not impeded. Such oscillation ensues and is enhanced by island 198 so that a swept jet issues from outlet slot 204 which is co-planar with outlet region 197. This provides a massaging effect on the body of the user as the jet sweeps back and forth at a frequency which is discernible to the body. Next assume that control member 183 is in the position illustrated in FIG. 26. Channel 206 interconnects passages 199 and 200 so that the feedback effect in feedback passages 194 and 195 is effectively short-circuited. More particularly, feedback fluid is not permitted to favor flow in only one feedback passage at a time due to the interconnection of these passages by channel 206. Consequently, there is always simultaneous feedback flow in both feedback passages 194, 195 and no fluidic oscillation ensues. However, island 198 produces oscillation, at a considerably higher frequency than the fluidically-induced oscillations. Moreover, slot 204 is perpendicular to the plane of outlet region 197 so that the smaller width of the slot, rather than its length, defines the outlet opening. This results in a swept sheet mode of operation at a frequency which is sufficiently high so as not to be perceived as a vibration or massage effect by the human body. As a result, this mode of operation provides an area coverage spray, effected by the sweeping sheet. Importantly, the area coverage is achieved through the same opening as the massage spray, eliminating the need for one or more rings of holes or passages as in conventional shower sprays. Prior single-outlet massaging showers have been able to cover large areas in a massaging mode; but these are also single mode devices. The present invention employs two different oscillatory mechanisms to provide both massage and spray modes from the same outlet. At intermediate positions of control member 183, as illustrated in FIG. 29, there is no short-circuiting of the feedback passages so that fluidic oscillation is permitted to occur. However, slot 204 is at an angle to the plane of outlet region 197 so that the outlet opening is effectively restricted. As described above, this interacts with island 198 to tend towards a swept sheet mode. The overall effect is a combined swept jet- swept sheet operation in which one or the other modes dominates depending upon which extreme position the control member is most proximate.

Figure 30:
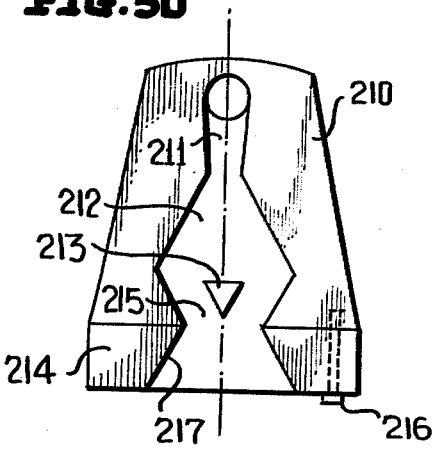
FIG. 30 is a plan view of a three-mode oscillator embodiment shown in a first operating mode.
Figure 32:
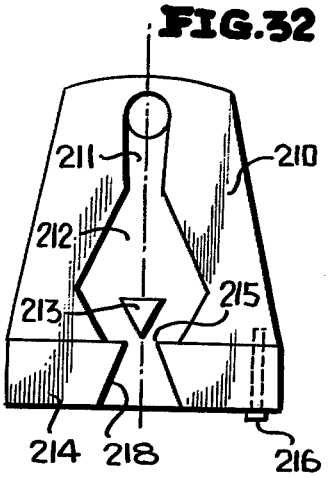
FIG. 32 is a plan view of the embodiment of FIG. 30 shown in a second operating mode.
Figure 33:
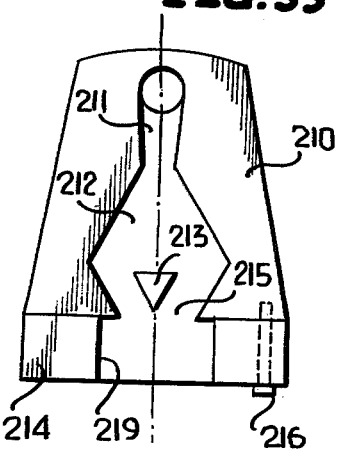
FIG. 33 is a plan view of the embodiment of FIG. 30 shown in a third operating mode.
Figure 31:
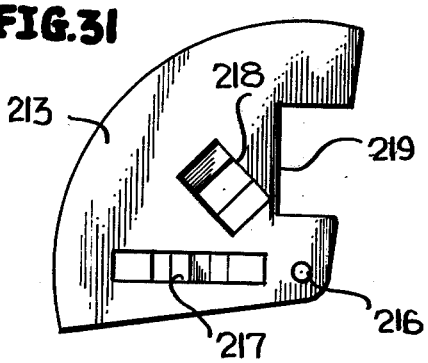
FIG. 31 is a front view of the embodiment of FIG. 30.

Still another multiple mode device is illustrated in FIGS. 30–33. Specifically, oscillator 210 includes a supply nozzle 211 which feeds applied pressurized liquid into a region 212. The sidewalls of region 212 first diverge and then converge to form a throat 215 at the downstream end of the region. A triangular island 213 is positioned just upstream of throat 215, sufficiently close so that the cavitation region which develops downstream of the island 213 extends beyond the throat. A control member 214 is in the form of a sector plate which is pivotably mounted on the forward or downstream end of the oscillator by means of a pivot pin 216 or the like. Sector plate 214 has a considerable thickness, sufficient, at least, to provide for the effects described below when considered in view of the mode-determining factors described in relation to FIG. 3. Control member 214 has three different openings 217, 218 and 219 defined therein, each opening being positioned to be aligned with throat 215 for a respective rotational position of sector plate 214. Opening 217, as viewed in FIGS. 30 and 31, is a rectangular opening of a width which is the same width as throat 215 with outwardly tapering sidewalls in a downstream direction. The height of opening 217 corresponds to the depth of the outlet throat 215 in the oscillator body. Opening 218, as viewed in FIGS. 31 and 32, is a rectangular opening of width which is narrower than throat 215 with sidewalls that also taper outwardly in a downstream direction. The height of opening 218 is slightly greater than the depth of throat 215. Opening 219, which is best seen in FIGS. 31 and 33, has a greater width than throat 215 and a considerably greater height than the depth of that throat.

When opening 217 is positioned over throat 215 a swept jet operating mode is provided. Throat 215 is unrestricted by opening 217 and the thickness of member 214 effectively extends the outlet region a sufficient distance downstream from the island to cause the swept jet mode.

When opening 218 is positioned over throat 215 the outlet is considerably restricted and the swept sheet mode is produced.

When opening 219 is positioned over throat 215 the throat is wide open to ambient air which interferes with vortex formation and shedding; the cavitation region extends out into the ambient environment and no sweeping or oscillation ensues. Instead, the two stream portions which flow around opposide sides of island 213 come together downstream of member 214 to provide a single unswept jet.

The three-mode device illustrated in FIGS. 30–33 has utilization in numerous applications such as personal spray devices (e.g. showers), and common household sprays, such as cleaners, etc. The ability to switch between full area coverage or swept sheet, linear coverage or swept jet, and point coverage or unswept jet, also permits extreme versatility for a variety of industrial spray applications.

Another multi-mode device according to the present invention is illustrated in FIGS. 34 through 38. An oscillator 220 includes a bottom plate 221, in which the oscillator passages are defined as recesses in one surface, and a top plate 222 which serves to seal the oscillator by being secured to the bottom plate by adhesive, screws, etc. Alternatively, oscillator 220, and the other oscillators described herein, may be made as a single piece in the manner described in relation to FIG. 12. In order to facilitate understanding of the drawing, top plate 222 is shown as clear or transparent plastic. An inlet hole 223 is defined through top plate 222 at one end thereof and is arranged to conduct applied pressurized fluid to a power nozzle 224 defined as part of the oscillator in the top surface of bottom plate 221. An interaction region 225 is arranged to receive the fluid jet issued from nozzle 224 and includes sidewalls which converge at the downstream end of the oscillator to define a throat 226.

Figure 34:
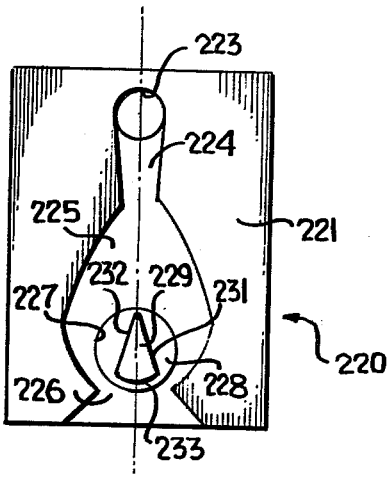
FIG. 34 is a top view in plan of another three-mode oscillator embodiment shown in a first operating mode.
Figure 37:
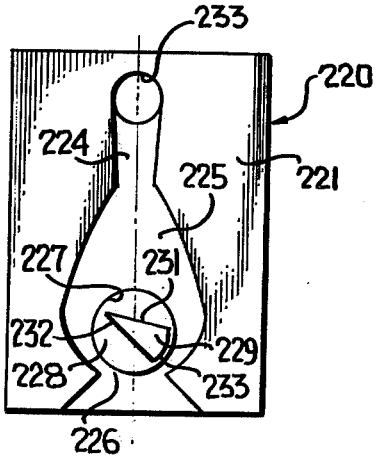
FIG. 37 is a top view in plan of the embodiment of FIG. 34 shown in a second operating mode.
Figure 35:
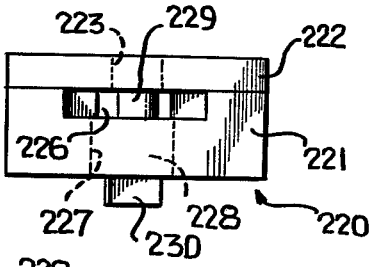
FIG. 35 is a front view of the embodiment of FIG. 34.
Figure 36:
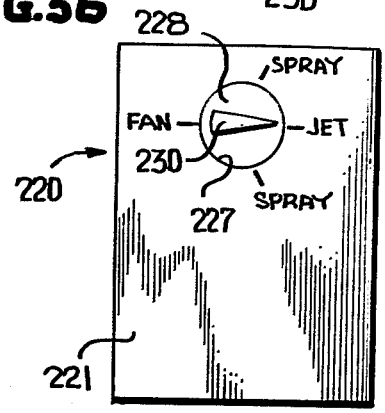
FIG. 36 is a bottom view of the embodiment of FIG. 34.
Figure 38:
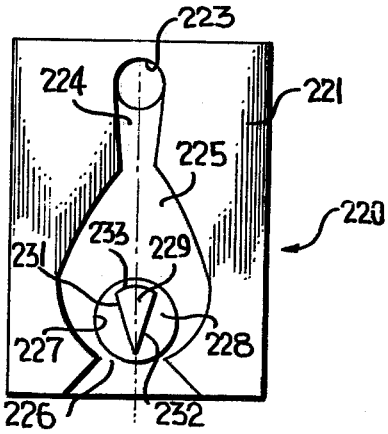
FIG. 38 is a top view in plan of the embodiment of FIG. 34 shown in a third operating mode.

Somewhat upstream of throat 226 there is a cylindrical hole defined through bottom plate 221. A cylinder 228 is rotatably secured in hole 227 in sealing relationship and so as to be rotatable about its longitudinal axis. The rotatable mounting may be effected by force-fitting the cylinder 228 into hole 227 with a suitable O-ring or other gasket therebetween; or a pivot pin may be extended through the cylinder 228 and journaled in top plate 222. The cylinder 228 has a length equal to the depth of the bottom plate 221 below the oscillator recesses, although the length may be shorter if desired. Atop the cylinder 228 is an obstruction or island 229 of generally sector configuration, having two straight sides 231, 232 which meet at a point and a shorter arcuate side 233 which joins the other ends of sides 231, 232. The height of island 229 is equal to the depth of the recesses in plate 221 which form the oscillator. A knob 230 projects from the bottom of cylinder 228, out through hole 227. Knob 230 is in the form of a pointer which, for different rotational positions of cylinder 228, can be made to selectively point to the designations "FAN," "SPRAY," and "JET," which are imprinted, stenciled, or otherwise provided on the bottom surface of plate 221. When the knob 230 is pointing to the "JET" designation, the apex between sides 231 and 232 of island 229 is pointing upstream in region 225 (FIG. 34). When knob 230 is pointing to the "SPRAY" designation, side 231 of island 229 is facing upstream (FIG. 37). When knob 230 is pointing at the "FAN" designation, arcuate side 233 of the island is facing upstream (FIG. 38).

The island 229 is positioned relative to throat 226 such that, when the apex between sides 231 and 232 is pointing upstream, the cavitation region formed downstream of side 233 extends downstream of oscillator into ambient environment. In addition, the absence of a blunt surface facing upstream precludes formation of vortices. Under such circumstances there is no vortex street established and the two flow portions which are separated by the island come together to form a single non-oscillating jet. When the arcuate side 233 is facing upstream the island 229 operates to provide a vortex street and side 233 is sufficiently far upstream to produce swept jet operation. When side 231 faces upstream it is further downstream (i.e. closer to throat 226) than is arcuate side 233 when the latter is facing upstream. Under such circumstances, the island produces a swept sheet operating mode.

Figure 41:
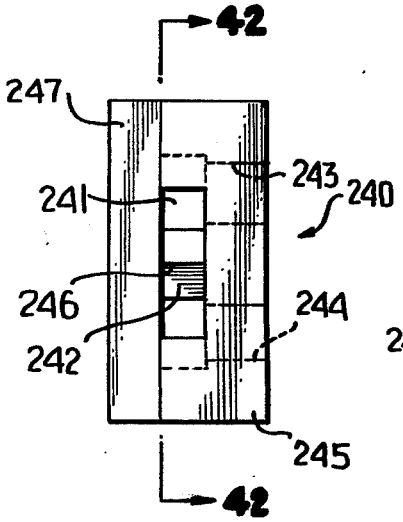
FIG. 41 is an end view of another embodiment of the present invention.
Figure 42:
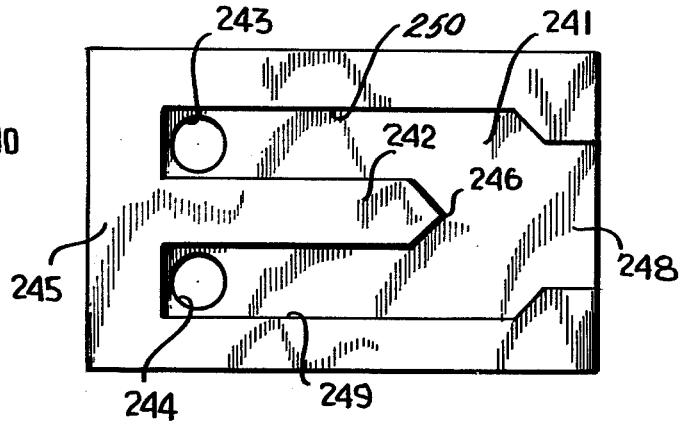
FIG. 42 is a view in section taken along lines 42—42 of FIG. 41.

The obstruction shown in the various embodiments destribed above is in the form of an island; that is, it is disposed in the interaction region or chamber in spaced relation to the chamber walls. It should be noted, however, that the vortex-inducing member, surface or obstruction need not be spaced from the chamber walls. By way of example, reference is made to FIGS. 41 and 42 wherein an oscillator 240 is illustrated as including a bottom plate 245, in which all of the oscillator passages and parts are defined, and a cover plate 247. A chamber or region 241 is defined as a recessed portion in the top surface of plate 245. The chamber has opposed sidewalls 249 and 250 which are substantially parallel to one another except near the downstream end of the chamber where the sidewalls diverge slightly to define an outlet 248. An elongated member 242 projects well into chamber 241 from the upstream end of the chamber. Member 242 projects in a downstream direction and has sides which are substantially parallel before tapering to an apex 246 at a location somewhat short of outlet 248. Member 242 extends to a height equal to the depth of chamber 241 so that it effectively bifurcates the upstream end of the chamber. In each leg of the bifurcation there is an inlet opening 243, 244 defined through plate 245, although these openings may likewise be defined through plate 247. Fluid which enters inlets 243 and 244 flows along the two paths defined between projection 242 and sidewalls 249 and 250. Upon reaching the tapered portion of the projection the fluid forms alternating vortices just downstream of where the taper begins. These vortices form a vortex street pattern which cyclically sweeps the flow so that a swept jet or swept sheet issues from outlet 248, depending upon the location of apex 246 relative to outlet 248.

It is noted that projection 242 in oscillator 240 is not an island as such but would be better characterized as a "peninsula." Nevertheless, it produces the vortex street required to effect the sweeping flow pattern. Also of interest in oscillator 240 is the fact that two inlets 243, 244 are provided. This feature, employing more than one inlet, is applicable to all of the embodiments described herein.

Figure 43:
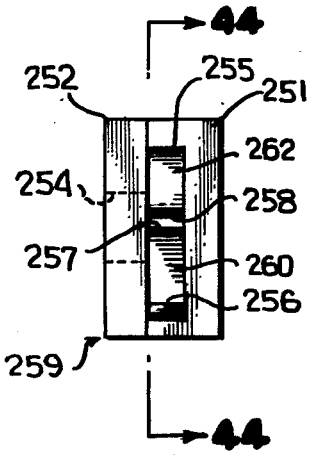
FIG. 43 is an end view of another embodiment of the present invention.
Figure 44:
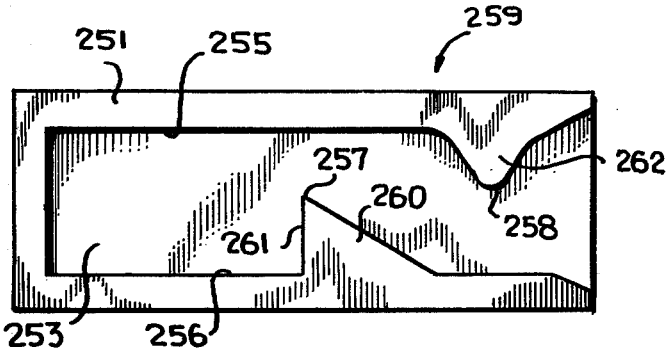
FIG. 44 is a view in section taken along lines 44—44 of FIG. 43.

Another embodiment of the present invention which varies from an island type of obstruction is illustrated in FIGS. 43 and 44 as oscillator 259. A bottom plate 251 has the oscillator chamber and ports defined therein as recesses in its top surface. A top or cover plate 252 abuts the top surface of plate 251 to seal the oscillator recesses. An inlet opening 254 is defined as a hole through plate 252 (although it may also be defined through plate 251) and communicates with chamber 253 of the oscillator. Chamber 253 is defined between sidewalls 255 and 256 which, in the upstream end of the chamber, are substantially parallel to one another. An obstruction 260 projects into chamber 253 from sidewall 256 and takes the form of a surface 261 projecting perpendicular to sidewall 256 substantially into the chamber. Surface 261 terminates at an edge 257 from which projection 260 tapers in a downstream direction before straightening out to extend parallel to the upstream portion of sidewall 256. Sidewall 255 also has a projection 262 which projects more gradually than projection 260 into chamber 253 and at a location downstream of projection 260. The inward-most part 258 of projection 262 is curved rather than being a sharp edge, and the downstream portion of projection 262 tapers toward the oscillator outlet at the downstream end of the chamber. In operation, projection 260 sheds vortices in the region just downstream of surface 261 along the tapered side of the projection. These vortices alternate in flow direction (i.e. clockwise and counterclockwise) and tend to form a vortex street. Projection 262 tends to restrict the region immediately downstream of the vortex formation location. The resulting flow pattern is not as symmetrical as that produced by the island obstruction or peninsula 242 of FIG. 42, in that the flow distribution is heavier on one side of the pattern than the other; nevertheless, distributable flow pattern does result. Symmetry could be achieved by providing a second projection like projection 260 from sidewall 255, located immediately opposite projection 260; and a further projection, like projection 262, from sidewall 256 immediately opposite projection 262.

Importantly, while the vortex street phenomenon is well-known in the prior art, no one has suggested that this phenomenon could be adapted to fluid dispersal as described herein; it is this adaptation of the vortex street phenomenon to permit fluid dispersal which is the most important aspect of the present invention. In a broader sense the invention involves providing a flow obstruction in a chamber between chamber inlet and outlet passages such that the obstruction of the flow produces alternating vortices on opposite sides of the flow, downstream of the obstruction, the alternating vortices serving to sweep the resulting flow back and forth in an oscillatory manner before the flow is issued into the ambient environment. Additional and also important aspects of the invention include: a multi-mode device which issues both a swept jet and a swept sheet, alternatively or in combination, from the same outlet; oscillation enhancement of conventional fluidic oscillators; and simple construction of a monolith or one-piece oscillator structure.

The particular obstruction shape and location and the chamber configurations described herein are not intended to be limiting on the present invention, it being understood that the placing of a vortex-inducing mechanism in the flow path to cause alternating vortex generation downstream of the mechanism which in turn produces an oscillating stream, and then issuing the oscillating stream into the ambient environment, is the essence of the invention.

Referring to FIG. 3, the spacing between the inlet opening 22 and island 27 may be considerably smaller; in fact, the spacing may be zero in that opening 22 can be located right at surface 28. Moreover, two or more inlet openings can be provided. Further, the dimension Z can be increased, either by lengthening sides 25, 26 or by extending a thin plate downstream from apex 29; in either case, vortex shedding ensues with the vortices being isolated from one another by the elongated island. Of course, the entire island may be more streamlined, if desired, much as an airplane wing or a boat hull, as long as there are vortices produced on opposite sides of the island. Further, the inlet opening may be defined in the top or bottom plates, the sidewalls, or the upstream end of the chamber, or any combination of these, as long as the flow impinges on the upstream-facing end of the island. The flow may fill the interaction chamber or not, depending upon the size of the chamber and pressure of the applied fluid.

While I have described and illustrated one specific embodiment of my invention, it will be clear that variations of the details of construction which are specifically illustrated and described may be resorted to without departing from the true spirit and scope of the invention as defined in the appended claims.

I claim:

1. A fluid oscillator device, comprising:

a body member having a chamber therein, said chamber having a fluid inlet for receiving fluid under pressure and admitting it into said chamber and a fluid outlet for issuing pressurized fluid from said chamber into an ambient environment, said inlet and outlet defining a flow path therebetween for flow of fluid through said chamber; and oscillation-inducing means for causing the fluid issued from said outlet to cyclically sweep back and forth, said oscillation-inducing means comprising surface means disposed in said flow path and responsive to fluid from said inlet impinging thereon for establishing alternating vortices in said fluid at side-by-side locations downstream of said surface means.

2. The device according to claim 1 wherein said oscillation-inducing means includes means for forming said issued fluid into a sheet which is in a plane normal to the sweeping direction.

3. The device according to claim 1 wherein said oscillation-inducing means comprises means for forming said issued fluid into a jet.

4. The device according to claim 1 wherein said oscillation-inducing means comprises adjustable means for selectively reconfiguring said device into at least two configurations, a first of said configurations including means for forming said issued fluid into a jet, a second of said configurations including means for forming said issued fluid into a sheet residing in a plane normal to the sweeping direction.

5. The device according to claim 4 further comprising means for selectively terminating said sweeping of said fluid and issuing a non-oscillating jet from said outlet.

6. The device according to claim 4 wherein said adjustable means includes means for selectively configuring said device into a third configuration including means for forming said issued fluid into a combined flow pattern including a swept jet and swept sheet.

7. The device according to claim 1 wherein said chamber, in the plane of fluid flow, includes sidewalls, and wherein said surface means comprises an obstruction member disposed in said chamber between said inlet and outlet and spaced from said sidewalls.

8. The device according to claim 7 wherein said obstruction member has a flat surface facing in an upstream direction toward said inlet.

9. The device according to claim 7 wherein in the plane of flow in said chamber, said obstruction member has a cross-section of generally triangular shape.

10. The device according to claim 7 further comprising means for selectively rotating said obstruction member about an axis which is perpendicular to the plane of flow in said chamber to face different portions of the periphery of said obstruction member in an upstream direction.

11. The device according to claim 7 further comprising means for selectively changing the size of said outlet to vary the flow pattern produced by the fluid issued therefrom.

12. The device according to claim 7 further comprising a second obstruction member disposed in said chamber downstream from said first-mentioned obstruction member and in a position to be impinged upon by flow which passes said first-mentioned obstruction member.

13. The device according to claim 7 further comprising means for selectively changing the distance between the said outlet and the upstream-most portion of said obstruction member.

14. The device according to claim 7 wherein the height of said chamber is smaller at said outlet than upstream of said obstruction member.

15. The device according to claim 7, further comprising a control member rotatably mounted on said device and having an opening therein disposed flush against and in alignment with said outlet, said opening being sized so as to restrict said outlet more for some rotational positions than for others.

16. The device according to claim 7 wherein said obstruction member has a triangular cross-section in the flow plane of said device, said triangular cross-section having a first side facing upstream and an opposite vertex pointing toward said outlet.

17. The device according to claim 7 wherein said obstruction member has a rectangular cross-section in the flow plane of said device, said rectangular cross-section having long sides facing upstream and downstream, respectively, and shorter sides facing the chamber sidewalls.

18. The device according to claim 1 wherein said surface means is a flat surface disposed perpendicular to the direction of flow along said flow path.

19. The device according to claim 18 further comprising control means for selectively repositioning said surface means in said chamber.

20. The device according to claim 1 wherein said body member is formed as a single piece.

21. A device for receiving pressurized fluid and issuing same in a cyclically swept pattern, comprising:

a chamber defined between a top wall, a bottom wall, an upstream end, a downstream end, and two side walls extending between said upstream and downstream ends;

at least one inlet opening defined through at least one of said top, bottom or side walls or said upstream end;

an outlet opening defined in said downstream end;

said inlet opening being adapted to receive pressurized fluid and admit same into said chamber, said outlet opening being adapted to issue fluid under pressure from said chamber into the ambient environment; and oscillation-inducing means for cyclically sweeping the flow issued from said outlet opening back and forth in the dimension between said sidewalls, said oscillation-inducing means comprising an island member located in said chamber, extending between said top and bottom walls and spaced from said sidewalls, said island member being positioned such that flow through said chamber from said inlet opening to said outlet opening must pass around both sides of said island member, said island member having upstream-facing surface means for alternately shedding vortices on opposite sides of said chamber immediately downstream of said surface means.

22. The device according to claim 21 wherein said island member has a generally triangular cross-section in a plane parallel to said top and bottom walls, said triangular cross-section having one side facing upstream and corresponding to said surface means.

23. The device according to claim 21 wherein said island member has a generally elliptic cross-section in a plane parallel to said top and bottom walls.

24. The device according to claim 21 wherein said island member has a generally rectangular cross-section in a plane parallel to said top and bottom walls.

25. The device according to claim 21 wherein said island member has a generally circular cross-section in a plane parallel to said top and bottom walls.

26. The device according to claim 21 further comprising manually-controlled mode control means for alternatively forcing first and second operating modes for said device, said first operating mode being such that a swept fluid jet is issued from said outlet opening, said second mode being such that a swept fluid sheet is issued from said outlet opening.

27. The device according to claim 26 wherein said control means comprises means for selectively restricting the area of said outlet opening.

28. The device according to claim 26 wherein said control means comprises means for selectively changing the distance between said surface means and the downstream end of said outlet opening.

29. The device according to claim 26 wherein said control means comprises means for selectively repositioning said island member in said chamber.

30. The device according to claim 21 wherein said top and bottom walls, said sidewalls, and said upstream and downstream ends are all formed in a single piece of plastic material.

31. The device according to claim 21 further comprising a second island member positioned between said first-mentioned island member and said outlet opening.

32. A device for receiving pressurized fluid and issuing same in a cyclically swept pattern, comprising:

a chamber defined between a top wall, a bottom wall, an upstream end, a downstream end, and two side walls extending between said upstream and downstream ends;

an inlet opening defined through at least one of said top, bottom or side walls or said upstream end;

an outlet opening defined in said downstream end;

said inlet opening being adapted to receive pressurized fluid and direct a jet thereof into said chamber, said outlet opening being adapted to issue said jet from said chamber into the ambient environment;

means for cyclically deflecting said jet back and forth in said chamber in a direction transverse to the flow direction of said jet, said means operating upon said jet at a point in said chamber proximate the upstream end; and an island member located in said chamber, extending between said top and bottom walls and spaced from said sidewalls, said island member being positioned such that said cyclically deflected jet must pass around both sides of said island member, said island member having upstream-facing surface means for alternately shedding vortices on opposite sides of said chamber immediately downstream of said surface means.

33. The device according to claim 32 wherein said island member has a circular cross-section in a plane parallel to said top and bottom walls.

34. The device according to claim 32 wherein said island member has a triangular cross-section in a plane parallel to said top and bottom walls.

35. The device according to claim 32 wherein said means for cyclically deflecting comprises control means, including a pair of opposed control ports opening into said chamber through said side walls proximate said upstream end of said chamber, for cyclically varying the pressure differential across said jet.

36. The device according to claim 35 wherein said control means includes feedback passages, one connected to each control port, for connecting said control ports to downstream regions of said device.

37. The device according to claim 36 further comprising:

means for selectively restricting said outlet opening; and means for selectively interconnecting said feedback passages to inhibit said means for cyclically deflecting.

38. The device according to claim 37 wherein said means for selectively restricting and said means for selectively interconnecting are part of a common member which is manually movable relative to said chamber.

39. The device according to claim 35 wherein said control means includes a source of alternating pressure differential connected to said control ports.

40. The device according to claim 32 wherein said means for cyclically deflecting comprises a further island member disposed upstream of said first-mentioned island member.

41. The device according to claim 32 further comprising means for selectively restricting said outlet opening.

42. A device for spraying fluid, comprising:

a body member having a chamber defined therein, said chamber having inlet and outlet openings;

means for applying fluid under pressure to said inlet opening; and sweep means in said chamber for causing fluid to issue from said chamber in the form of a sheet which is cyclically swept back and forth in a direction transverse to the flow direction of said sheet, whereby said swept sheet breaks up into small particles which are dispersed over a two-dimensional area when impinging upon a target disposed in the flow path of said swept sheet.

43. The device according to claim 42 wherein said sweep means comprises a further member disposed in said chamber so as to be impinged upon by flow between said inlet and outlet openings, said further member having surface means for alternately shedding vortices on opposite sides thereof when impinged upon by said flow.

44. The device according to claim 43 wherein said further member has a triangular cross-section in a plane parallel to the sweeping direction, and wherein said surface means corresponds to one side of said triangular cross-section which is oriented to face upstream in said chamber.

45. The device according to claim 43 wherein said further member has a continuously curved cross-section in a plane parallel to the sweeping direction.

46. The device according to claim 42 further comprising manually-operated control means for modifying said sweep means to convert outflow from said body member to a swept jet.

47. The device according to claim 42 wherein said body member is a one-piece unit.

48. The method of spraying fluid comprising the steps of:

introducing fluid under pressure into a chamber;

flowing introduced fluid through said chamber toward an outlet opening;

establishing a vortex street in said flowing fluid in said chamber to cause said flowing fluid to sweep back and forth; and issuing the sweeping flow from said outlet opening into the ambient environment.

49. The method according to claim 48 wherein the sweeping flow issued from said outlet opening is a swept jet of fluid.

50. The method according to claim 48 wherein the sweeping flow issued from said outlet opening is a swept sheet of fluid.

51. A device for spraying fluid comprising:

a body member made of a single piece of injection molded plastic material;

a chamber defined in said body member, said chamber having inlet and outlet openings;

means for supplying pressurized fluid to said inlet opening;

said outlet opening being positioned to issue pressurized fluid from said chamber into the ambient environment; and means in said chamber, forming part of said body member, for forming a cyclically swept flow pattern in said chamber, which flow pattern is issued from said outlet opening.

52. A device for receiving pressurized fluid and dispersing that fluid in a cyclically swept flow pattern, said device comprising:

a body member;

a chamber defined in said body member, said chamber having a top wall, a bottom wall, an upstream end, a downstream end, and two opposed sidewalls extending between said upstream and downstream ends;

an inlet opening into said chamber, said inlet being adapted to receive pressurized fluid and admit it into said chamber;

an outlet opening defined through the downstream end of said chamber for issuing fluid under pressure from said chamber into the ambient environment; and oscillation-inducing means in said chamber for causing fluid flowing through said chamber to issue from said outlet opening in a cyclically sweeping flow pattern, said oscillation-inducing means comprising a body having surface means disposed between said inlet and said outlet opening to create a cavitation region downstream of the surface means in which vortices of alternating clockwise and counterclockwise flow directions are formed and travel along with the flow.

53. The device according to claim 52 wherein:

said body member comprises a further member projecting from said upstream end and tapering toward said downstream end;

said inlet opening means comprises at least one inlet for said pressurized fluid located at each side of said further member; and said cavitation region being located immediately downstream of said further member at the general area of confluence of flows from said inlets.

54. The device according to claim 52 wherein said body member comprises a further member projecting into said chamber from one of said sidewalls.

55. The device according to claim 54 wherein said further member includes a surface disposed substantially perpendicular to flow through said chamber and terminated in a sharp edge, said further member tapering gradually back to said one of said sidewalls in a downstream direction from said sharp edge; and wherein said cavitation region is located in the space downstream of said sharp edge wherein said further member gradually tapers toward said one of said sidewalls.

56. The device according to claim 55 further comprising flow restrictor means disposed in said chamber downstream of said further member.

57. The device according to claim 56 wherein said flow restrictor means comprises a projection extending inwardly into said chamber from the other of said sidewalls.

58. A device for receiving pressurized fluid and issuing same in a fan-shaped spray pattern, comprising:

a chamber defined between a top wall, a bottom wall, an upstream end, a downstream end, and two side walls extending between said upstream and downstream ends;

an inlet opening defined through at least one of said top, bottom, or side walls or said upstream end;

an outlet opening defined in said downstream end;

said inlet opening being adapted to receive pressurized fluid and direct a jet thereof into said chamber, said outlet opening being adapted to issue said jet from said chamber into the ambient environment; and an island member located in said chamber, extending between said top and bottom walls and spaced from said sidewalls, said island member being positioned such that said jet must pass around both sides of said island member, said island member having upstream-facing surface means for alternately shedding vortices on opposite sides of said chamber immediately downstream of said surface means.

* * * * *